US006447084B1

(12) United States Patent
Uetsuki et al.

(10) Patent No.: US 6,447,084 B1
(45) Date of Patent: Sep. 10, 2002

(54) INK-JET PRINTING APPARATUS, INK-SUPPLYING APPARATUS AND METHOD FOR SUPPLYING INK

(75) Inventors: Masaya Uetsuki; Yohji Ara; Hiroyuki Inoue, all of Yokohama; Hideo Fukazawa, Chigasaki; Tetsuji Kurata, Yokohama; Hirofumi Hirano, Zama; Hiroshi Netsu; Hideaki Okamoto, both of Yokohama; Hiroki Hayashi, Kawasaki; Noriyasu Asaki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/583,570

(22) Filed: May 31, 2000

(30) Foreign Application Priority Data

May 31, 1999 (JP) ..... 11-153061

(51) Int. Cl.[7] ..... B41J 2/195
(52) U.S. Cl. ..... 347/7; 347/85
(58) Field of Search ..... 347/7, 6, 5, 85, 347/84, 28, 89, 86, 92, 93

(56) References Cited

U.S. PATENT DOCUMENTS 4,187,511 A * 2/1980 Robinson ..... 347/7
4,967,207 A * 10/1990 Ruder ..... 347/7
5,479,193 A 12/1995 Shimoda et al. ..... 347/7
5,757,390 A * 5/1998 Gragg et al. ..... 347/7
6,106,108 A * 8/2000 Cluet ..... 347/7

FOREIGN PATENT DOCUMENTS

| | | |
|---|---|---|
| JP | 59-207256 | 11/1984 |
| JP | 7-32606 | 2/1995 |
| JP | 8-187874 | 7/1996 |
| JP | 8-300681 | 11/1996 |
| JP | 10-128999 | 5/1998 |
| JP | 10-315493 | 12/1998 |
| JP | 11-20183 | 1/1999 |

* cited by examiner

*Primary Examiner*—Craig A. Hallacher
(74) *Attorney, Agent, or Firm*—Fitzpatrick, Cella, Harper & Scinto

(57) ABSTRACT

An ink-jet printing apparatus, an ink-supplying apparatus, and a method for supplying ink are configured so that a mode of ink supply is changed to another mode, for example the mode of supplying ink to an ink tank is changed to another in accordance with a fact that a next page is intended to be printed or not, when an ink tank that requires the supply of ink is detected, with the result that the printing speed is increased.

38 Claims, 26 Drawing Sheets

INK-JET PRINTING APPARATUS, INK-SUPPLYING APPARATUS AND METHOD FOR SUPPLYING INK

This application is based on Patent Application No. 11-153061 (1999) filed May 31, 1999 in Japan, the content of which is incorporated hereinto by reference.

BACKGROUND OF THE INVENTION

1. Field of the Invention

The present invention relates to an ink-jet printing apparatus, an ink-supplying apparatus, and a method for supplying ink.

2. Description of the Related Art

There are several systems for supplying ink to an ink-jet printing apparatus, such as a so-called on-carriage tank system, tube system, and on-demand systems.

The on-carriage tank system, in a serial-scan type printing apparatus, supplies ink to a printing head mounted on a carriage from an ink tank mounted on the carriage. The tube system supplies ink from an external ink tank to a printing head through a tube that connects them together. In this case, the external ink tank is placed on the outside of the carriage. Furthermore, the on-demand type system supplies ink from a second ink tank provided on the body of a printing apparatus to a first ink tank provided on the carriage by connecting them together at the time of ink-supply.

An example of the ink tank to be used in the on-carriage tank system is the one integrally provided with a printing head. Alternatively, another example of such an ink tank is one removably connected to the printing head. The removable ink tank can be removed from the printing head and replaced with new one, so that it is possible to keep the printing head in place without throwing away and to carry out a reduction of running costs. In the on-carriage tank system using such an ink tank, the frequency of replacing the ink tanks should be reduced for reducing the running costs and reducing the burdens on the operator. In this case, however, the capacity of the ink tank should be increased, proportionally resulting in the incrementing of the carriage weight, upsizing of the body of the apparatus, and enhancement of both the carriage-driving and carriage-driving parts.

In the tube system, furthermore, the tube applies a large load on the movement of the carriage. In particular, recently, the weight of the ink-supplying portion tends to be increased because the tube that allows the increased supply of ink is required as printing speed increases. In addition, the tube may be curved due to the movement of the carriage, so that an image formation may be unevenly performed as a result of the variations in the pressure of supplying ink. The necessity to make a large pressure for supplying ink to fill the tube with ink in the case of filling an empty tube with ink at an early stage of the ink-supply. Moreover, there is a problem that it takes much time and so on.

For solving the problems of both the on-carriage tank system and tube system, another system of the ink supply is suggested. In the system, an ink tank (an on-carriage ink tank) of the side of carriage and an ink tank on the side of printing apparatus is connected together only when required to supply ink. Ink is supplied from the latter ink tank to the former ink tank.

In the meantime, whatever an ink-supplying system may be, in the case where an ink-supplying timing is set when the ink residue in the ink tank decreases to predetermined quantity, the following problems occur.

That is, for example, when an ink-supplying timing is generated during image printing operation using a printing head, the printing operation is suspended, and ink must be supplied. During ink-supplying operation, image printing operation is impossible, and thus, a nominal printing speed is lowered. Before and after ink supply, there may occur a remarkable difference in permeation of the ink ejected on the printing medium. In this case, band-shaped printing non-uniformity is generated on a printing image.

SUMMARY OF THE INVENTION

An object of the present invention is to provide an ink-jet printing apparatus, an ink-supplying device, and a method for supplying ink, where the manner of ink supply is modified so that an image formation is performed at a high printing rate.

In a first aspect of the present invention, there is provided an ink-jet printing apparatus for printing an image on a printing medium using an ink jet printing head that is capable of eject ink supplied from an ink tank, comprising:

ink-supplying means that is capable of supplying ink to the ink tank;

detecting means for detecting the time of ink-supply as the ink tank requires the supply of ink; and control means that makes a change to a mode of supplying ink to the ink tank by the ink-supplying means in accordance with the status of actuating the ink-jet printing apparatus at the time of ink-supply which is determined by the detecting means.

In a second aspect of the present invention, there is provided an ink-supplying apparatus to be actuated in relation to the operation of an ink-jet printing apparatus that performs an image formation on a printing medium using an ink-jet printing head that is capable of ejecting ink to be supplied from an ink tank, comprising:

ink-supplying means that is capable of supplying ink to the ink tank;

detecting means for detecting the time of ink-supply as the ink tank requires the supply of ink; and control means that makes a change to a mode of supplying ink to the ink tank by the ink-supplying means in accordance with the status of actuating the ink-jet printing apparatus at the time of ink-supply which is determined by the detecting means.

In a third aspect of the present invention, there is provided a method for supplying ink, which is related to the operation of an ink-jet printing apparatus that performs an image formation on a printing medium using an ink-jet printing head that is capable of ejecting ink to be supplied from an ink tank, comprising:

an ink-supplying means that is capable of supplying ink to the ink tank; and comprising the steps of:

detecting the time of ink-supply as the ink tank requires the supply of ink; and making a change to a mode of supplying ink to the ink tank by the ink-supplying means in accordance with the status of actuating the ink-jet printing apparatus at the time of ink-supply.

The present invention is configured such that the manner of ink supply is changed in accordance with the time when the supply of ink to an ink tank is required. This offers an advantage of being able to perform the action of ink supply so as to appropriately fit to the operating status of the ink-jet printing apparatus. Therefore, it is possible to increase the printing rate.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below by referring to the accompanying drawings.

[First Embodiment]

Figure 1:
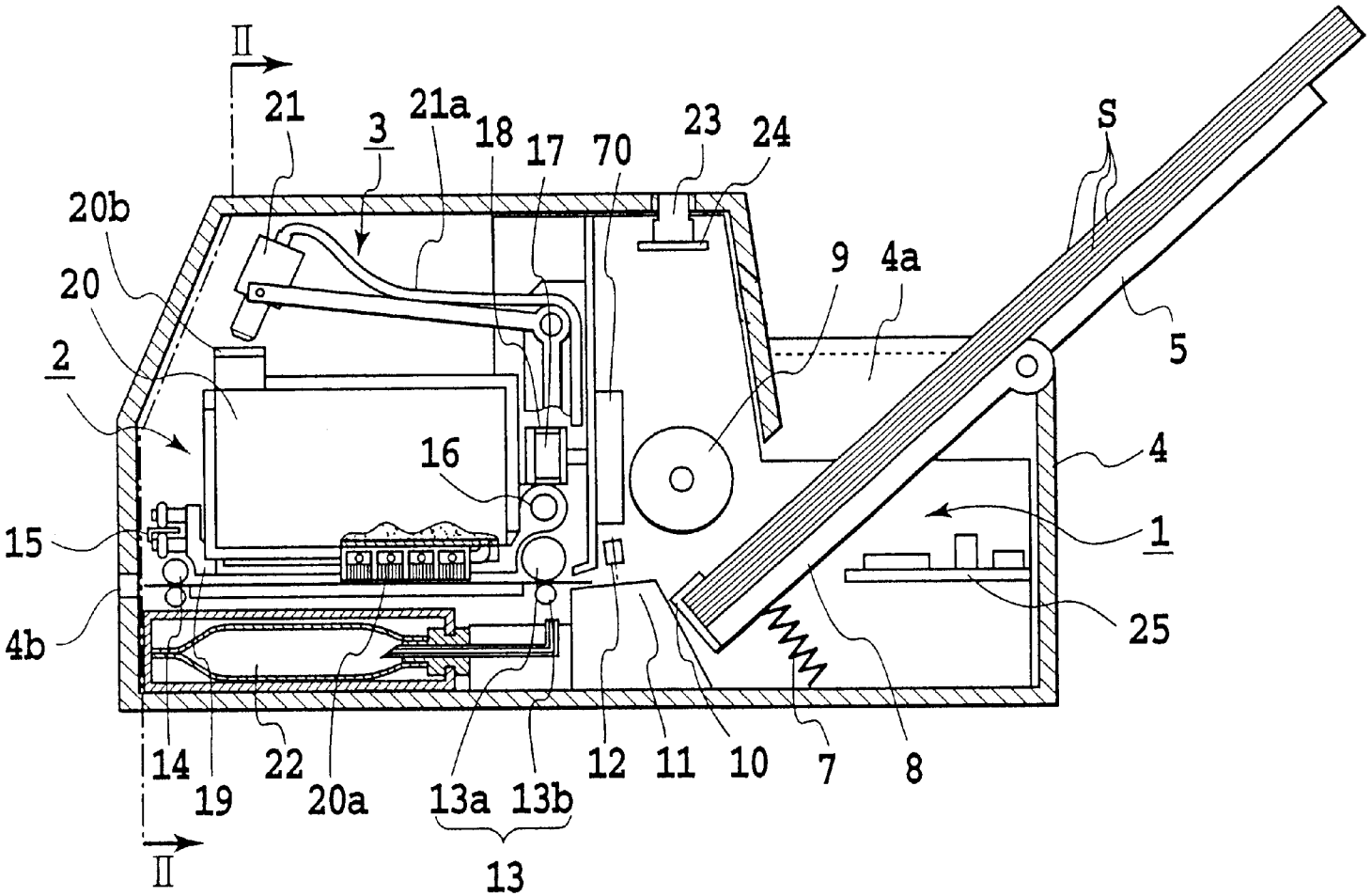
FIG. 1 is a cross sectional view of the printing apparatus in accordance with the first embodiment of the present invention.
Figure 2:
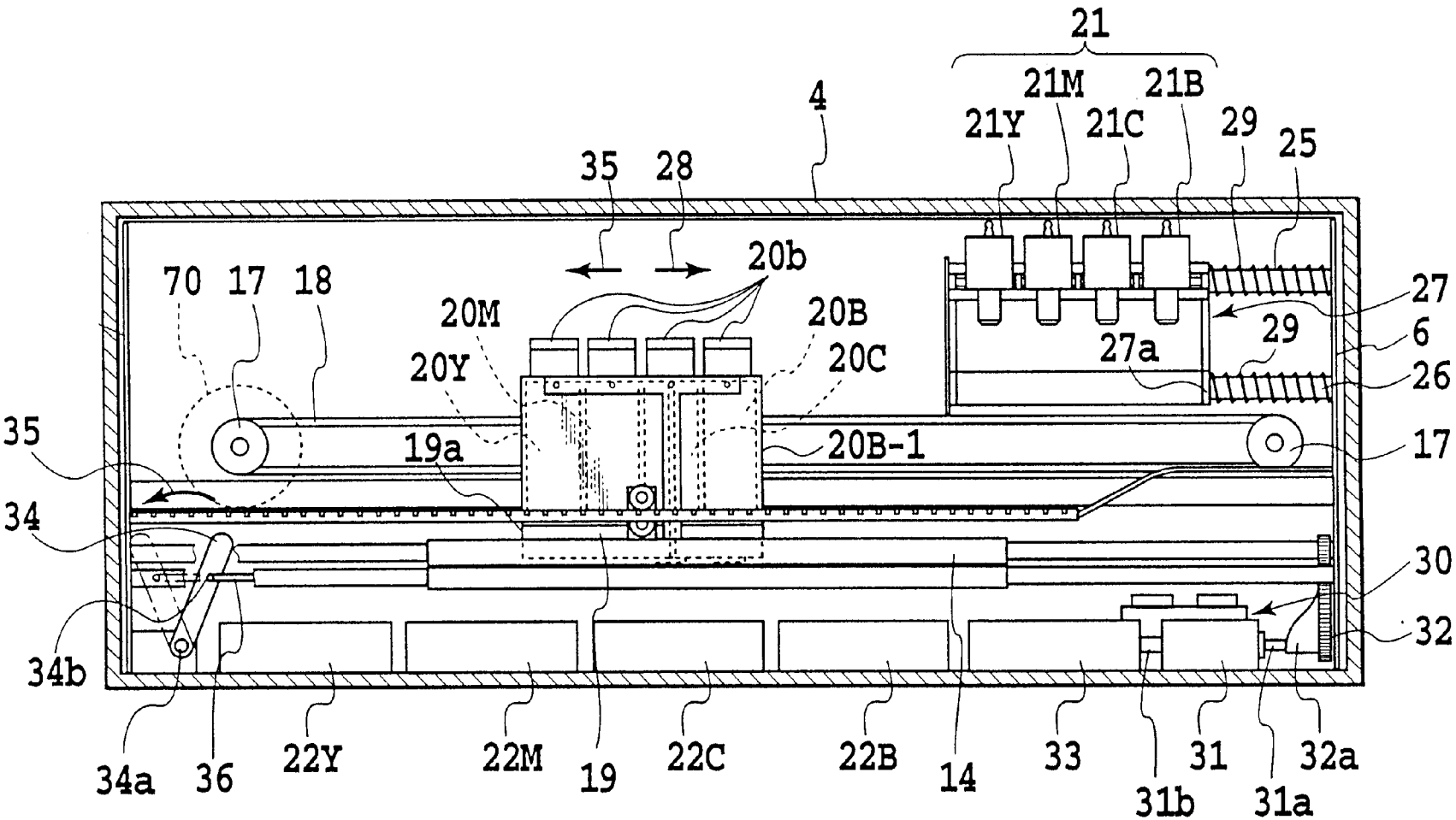
FIG. 2 is a cross sectional view along the line II—II sin FIG. 1.

FIG. 1 and FIG. 2 illustrate the overall configuration of an ink-jet printing apparatus in accordance with a first preferred embodiment of the present invention. In this embodiment, the ink-jet printing apparatus applies to a serial-scanning system in which a printing head moves in the direction of main-scanning (i.e., the main-scanning direction).

Figure 6:
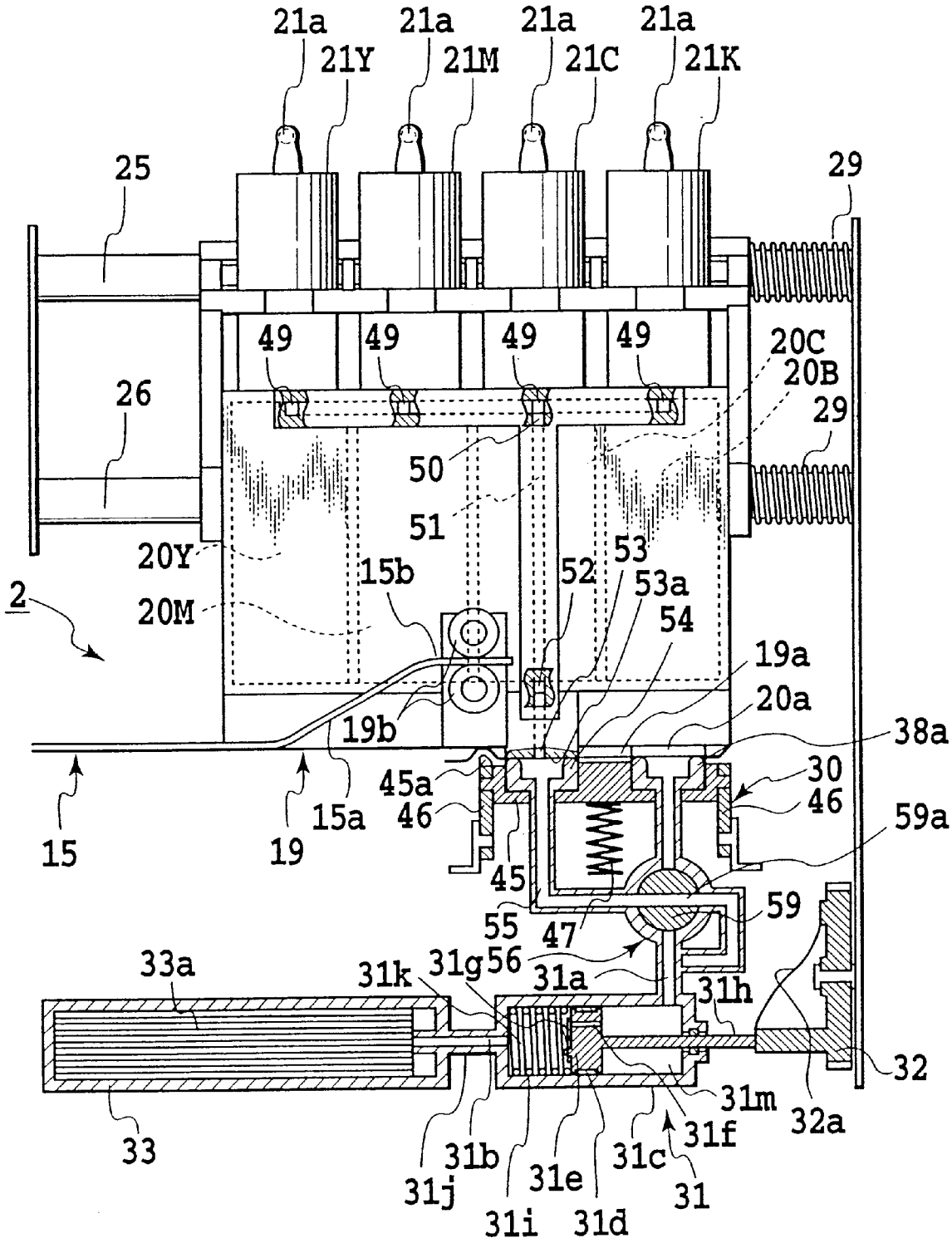
FIG. 6 is a cross sectional view of the air suction system during the period of supplying ink to the reserve ink tank shown in FIG. 3.

In FIG. 1, a main body of the printing apparatus comprises a transport device portion 1 for feeding a printing medium S such as a sheet of paper, a printing device portion 2 for performing a printing movement, an ink-supplying device portion 3 for supplying ink to the printing device portion 2, and a capping device portion 30 (see FIG. 6). These device portions 1, 2, and 3 will be individually described as follows.

A. [Configuration of the Transport Device Portion 1]

In the transport device portion 1, the reference numeral 4 denotes a cover. The cover 4 is provided on an external side of a main body of the printing apparatus. The reference numeral 5 denotes a platform on which a plurality of printing media S is placed. The cover 4 has an insertion opening 4*a* and an ejection opening 4*b*, so that the printing medium S is inserted into the insertion opening 4*a* and ejected from the ejection opening 4*b*. In the inside of side walls provided in the cover 4, a mounting base 8, a feed roller 9, and a guide member 11 are provided. The mounting base 8 is provided as a means for holding the printing media S. The mounting base 8 moves upward and pressed against the feed roller 9 by an extending force of a spring 7. The feed roller 9 is a part of feeding means and comes into contact with the topmost printing medium S on the mounting base 8. The guide member 10 leads a sheet of the printing medium S separated from a batch of the printing medium S by separating means 10 toward the printing portion device 2.

B. [Configuration of the Printing Device Portion 2]

In the printing device portion 2, the reference numeral 12 denotes a photo-sensor for detecting the printing medium S passing through the downstream side of the guide member 11. The reference numeral 13 denotes a pair of transport rollers that transports the printing medium S at a constant speed, which is fed from the transport device portion 1. The reference numeral 14 denotes a pair of carrying out rollers that carries out the printing medium S on which an image is printed. The reference numeral 19 denotes a carriage which is movably supported by guide members 15, 16, so that these guide members 15, 16 are able to guide the movement of the carriage 19 in the main scanning direction indicated by the arrows 28, 35 in FIG. 2. The main scanning direction corresponds to the direction along a width of the printing medium S. Therefore, the carriage 19 is able to shift its position along the guide members 15, 16 in the main scanning direction by means of a driving force of a carriage motor 70 transmitted through a belt 18 that runs between pulleys 17 and 17. The reference numeral 20 denotes a replaceable reserve ink tank to be mounted on the carriage 19, while 20*a* denotes a printing head as a means for forming an image on the printing medium S. Depending on image information, the printing head 20*a* ejects ink supplied from the reserve ink tank 20. In the present embodiment, the reserve ink tank 20 and the printing head 20*a* are combined together to form an ink-jet cartridge. Alternatively, these components 20, 20*a* may be individually provided so that they can be detachably connected to each other and individually mounted on the carriage 19.

As shown in FIG. 2, the reserve ink tank 20 of the present embodiment is divided into four ink tanks for reserving respective colors of ink, i.e., an ink tank 20Y for yellow colored ink, an ink tank 20M for a magenta colored ink, an ink tank 20C for cyan colored ink, and an ink tank 20B for black colored ink. Each of these ink tanks 20Y, 20M, 20C, and 20B has an ink inlet 20*b* for the admission of ink. The ink inlet 20B is formed as a valve member made of a flexible material such as a rubber.

Figure 4:
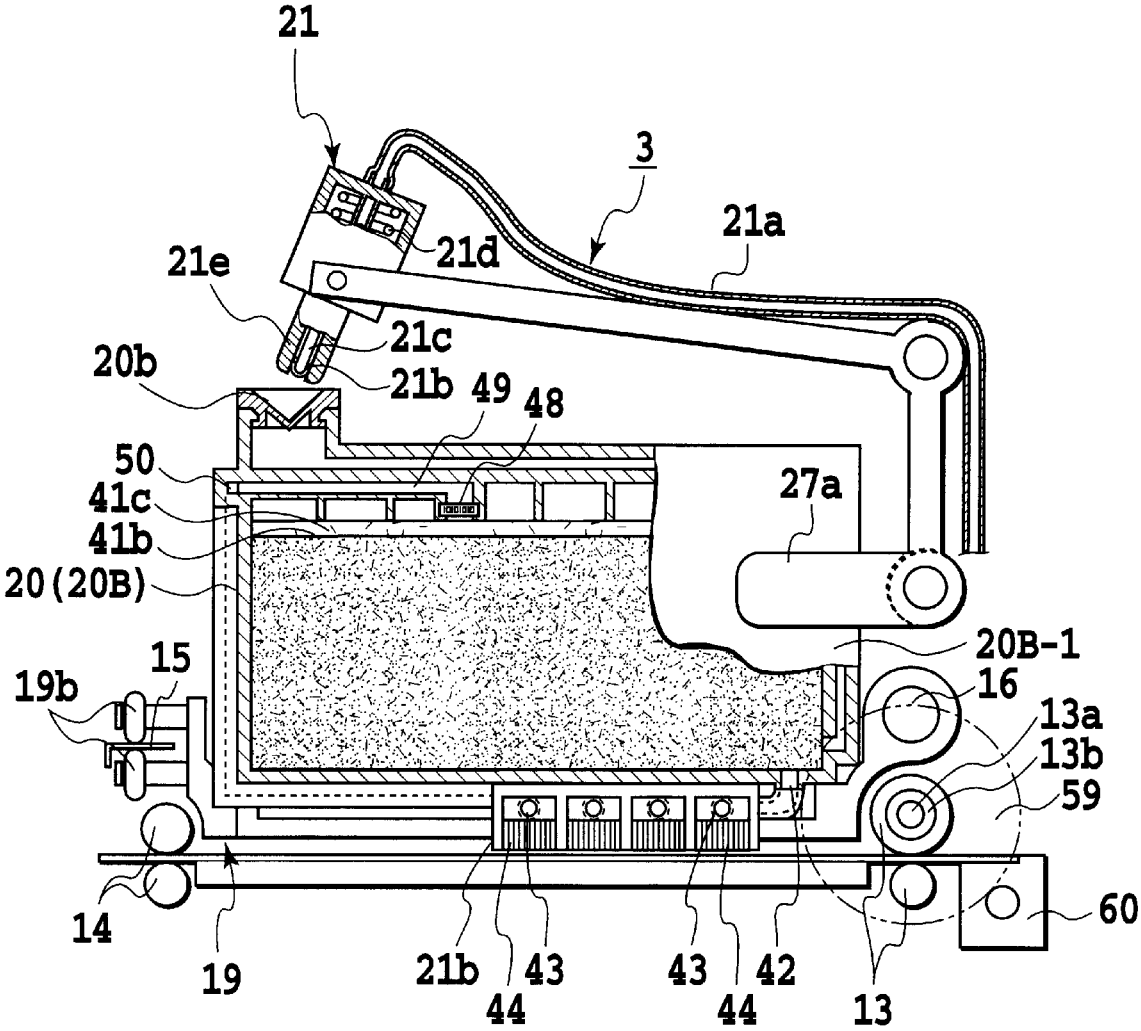
FIG. 4 is a cross sectional view of the reserve ink tank shown in FIG. 3.
Figure 7:
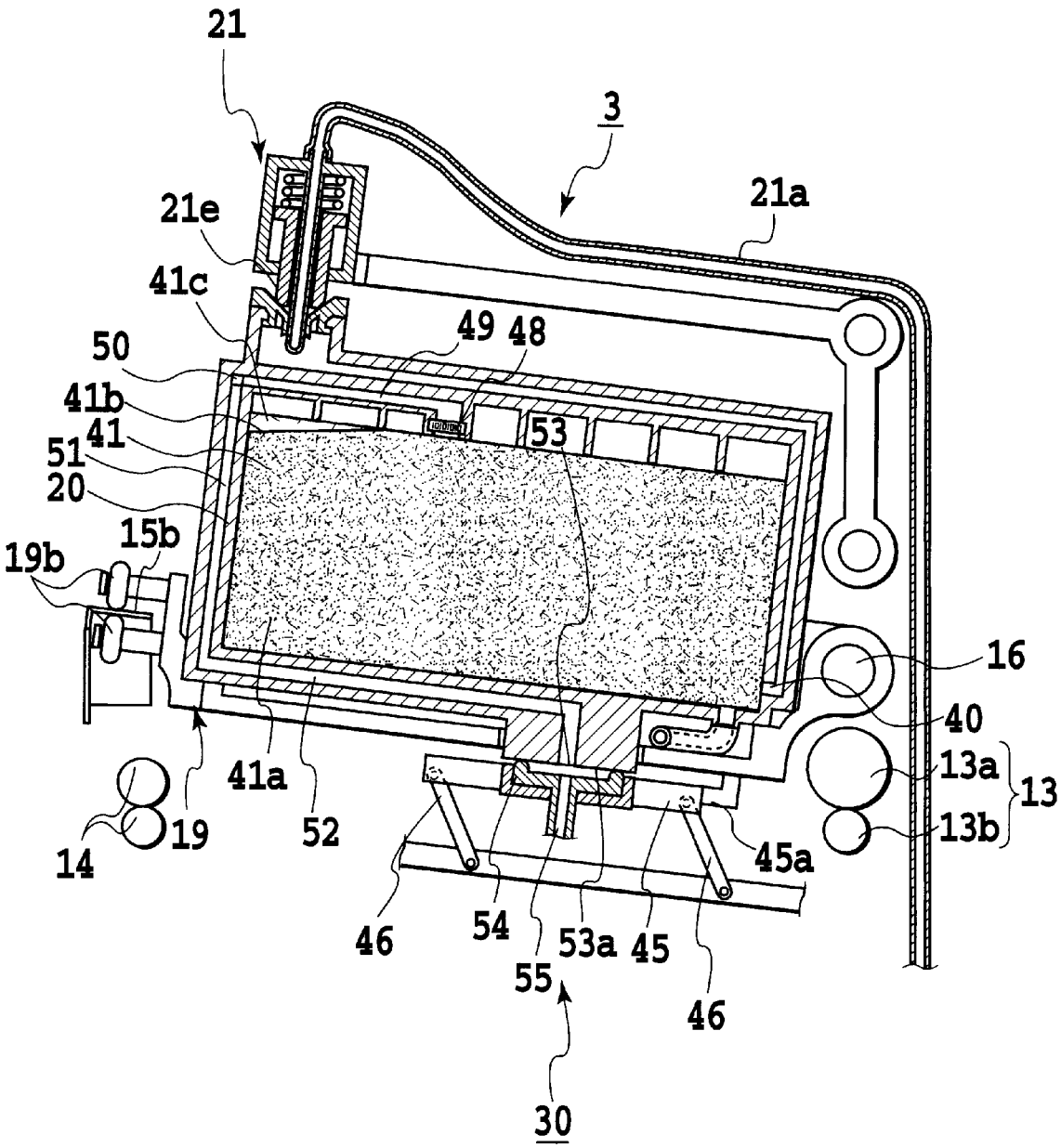
FIG. 7 is a cross sectional view of the reserve ink tank shown in FIG. 3 during the period of supplying ink to the reserve ink tank.

The reference numeral 48 in FIG. 4 denotes a gas-permeable member provided in a suction opening of each of the ink tanks 20Y, 2M, 20C, and 20B. The gas-permeable member 48 is provided as a means of separating air and liquid, which permeates gas but not ink. The gas-permeable member 48 may be of a thin-sheet type and made of a tetrafluoride ethylene resin or other porous resin materials. As shown in FIG. 6 and FIG. 7, each of passages for exhausting air in the ink tanks 20Y, 20M, 20C, and 20B communicates with the gas-permeable member 48 and an air ventilating path 49 and then communicates with a general suction hole 53 through common air ventilating paths 50, 51, and 52. Air in the ink tanks 20Y, 20M, 20C, and 20B can be sucked out of a cap member 54 closely adjacent to a surface 53*a* on which the general suction hole 53 is formed. As described later, the suction of air can be performed by a suction pump 31 through a ventilation tube 57.

The printing head 20*a* consists of a plurality of head parts. These parts are independent one another in every ink and comprises a plurality of ink eject nozzles 44 and their own liquid chambers 43 communicating with channels 41 of the respective ink tanks 20Y, 20M, 20C, and 20B. Each of the nozzles 44 forms a communicating passage that communicates with an ink eject port. In addition, each of the nozzles 44 has a means for generating an energy to be used for ejecting ink from the ink eject port.

C. [Configuration of the Ink-supplying Device Portion 3]

In the ink-supplying device portion 3, the reference numeral 21 denotes a means for supplying ink, which communicates with a supplementary ink tank 22 through the tube 21*a*. This ink-supplying means 21 replenishes ink of the supplementary ink tank 22 into the reserve ink tank 20 by tightly connecting to the ink inlet 20*b* of the reserve ink tank 20.

The supplementary ink tank 22 of this embodiment is divided into four ink tanks for reserving respective colors of ink, i.e., an ink tank 22Y for yellow colored ink, an ink tank 22M for a magenta colored ink, an ink tank 22C for cyan colored ink, and an ink tank 22B for black colored ink. Each ink tank 22Y, 22M, 22C, and 22B are connected to their respective ink-supplying means 21Y, 21M, 21C, 21B which cope with every color of ink through the associated inner tube 21*a*.

As shown in FIG. 2, furthermore, the ink-supplying means 21 is mounted on a migration board 27. The migration board 27 is guided by a guide member 25, 26 so as to be able to move in the left-right direction of FIG. 2. If the carriage 19 moves in the direction of the arrow 28, and the side surface 20B-1 of the reserve ink tank 20B runs into an arm portion of the migration board 27, the migration board 27 moves together with the carriage 19 in the direction of the arrow 28 against the force of a spring 29.

Figure 3:
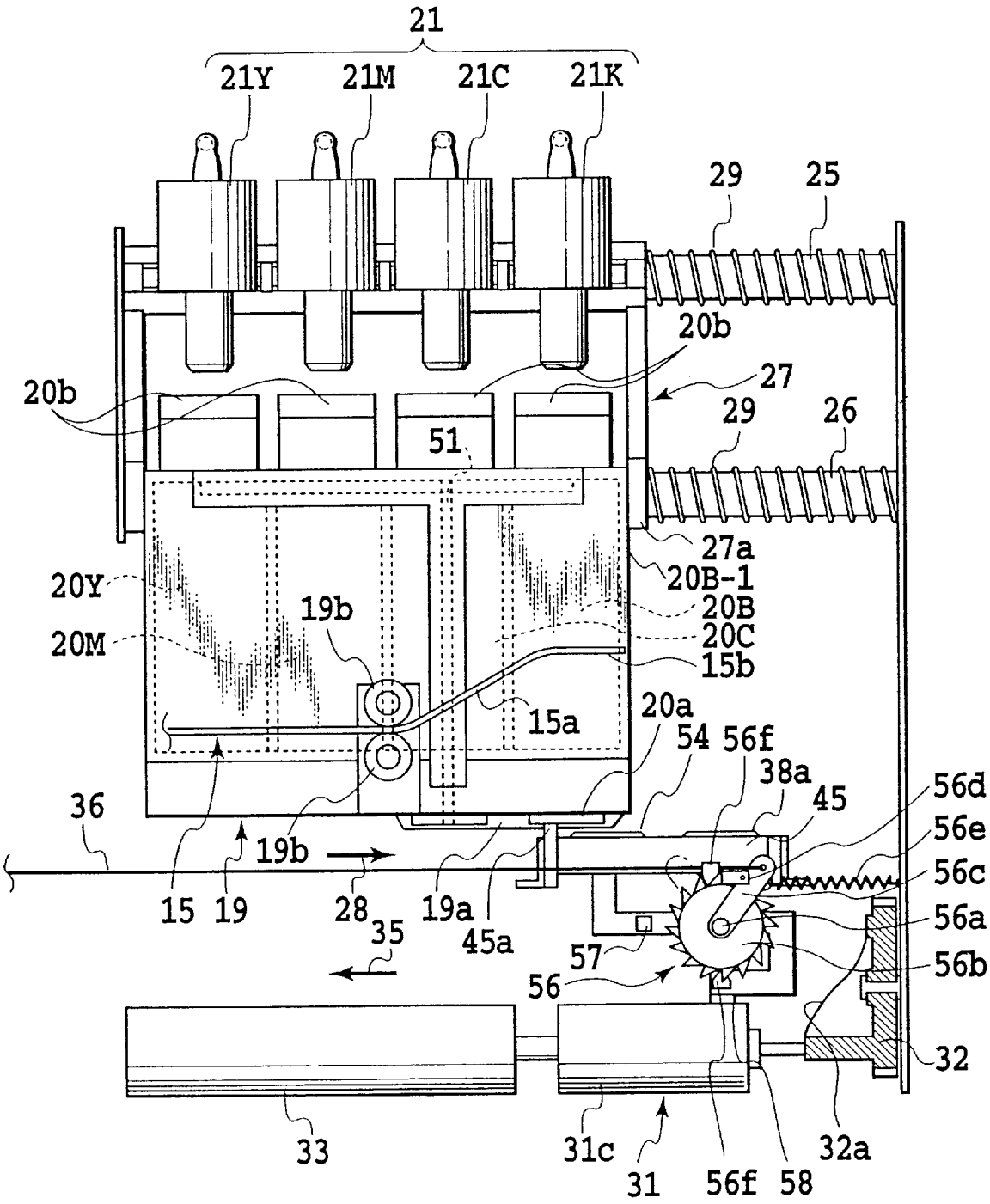
FIG. 3 is an enlarged front view of the reserve ink tank portion shown in FIG. 2.
Figure 5:
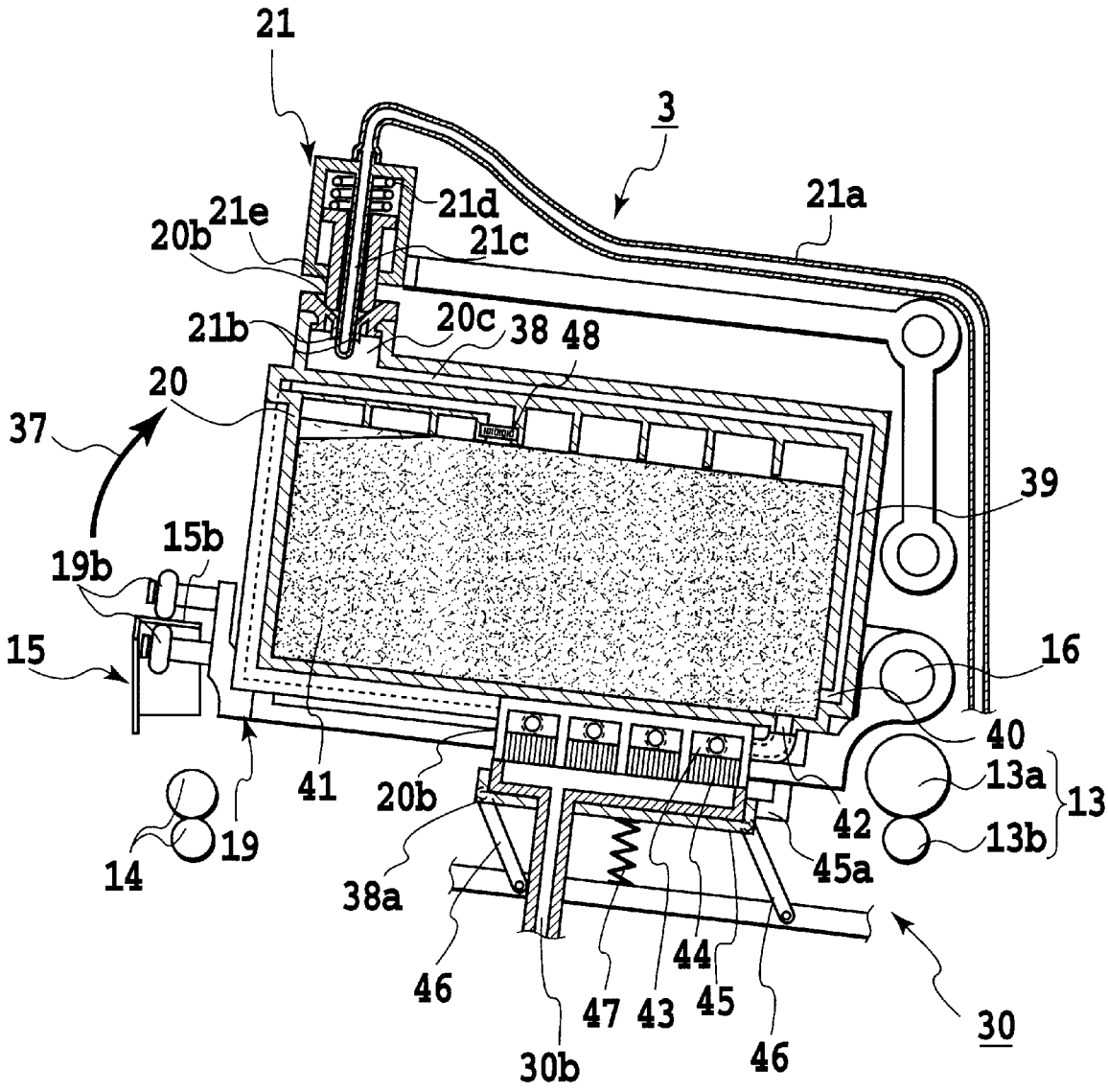
FIG. 5 is a cross sectional view of the reserve ink tank shown in FIG. 3 while the reserve ink tank is tilted to a predetermined angle.

In addition, as shown in FIG. 5, the carriage 19 turns around the guide member 16 as an axis on in the direction of the arrow 37 by moving the carriage 19 in the direction of the arrow 28. By the rotation of the carriage 19, connection between the ink-supplying means 21 and the ink inlet 20*b* of the reserve ink tank 20 is made. That is, as shown in FIG. 3, a pair of guide rollers 19*b* is mounted on the carriage 19 for supporting the carriage 19 on the guide member 15. If the carriage 19 moves in the direction of the arrow 28, the side surface 20B-1 of the reserve ink tank 20B runs against the arm portion 27*a* of the migration board 27. Consequently, the migration board 27 begins to move together with the carriage 19 in the direction of the arrow 28. Subsequently, a pair of the guide rollers 19*b* moves from a tilted portion 15*a* of the guide member 15 to a horizontal portion 15*b* thereof. Accordingly, as shown in FIG. 5, the carriage 19 turns around an axis of the guide member 16 in the direction of the arrow 37, resulting in the connection between the ink-supplying means 21 and the ink inlet 20*b* of the reserve ink tank 20.

As shown in FIG. 4 and FIG. 5, the ink-supplying means 21 comprises a needle 21*c* having a hollow body with a closed tip end. The closed tip of the needle 21*c* has a pore 21*b* passing through a circumferential surface thereof in the radial direction (the left-right direction of FIG. 5). In addition, a piston-shaped bung member 21*e* is co-axially provided on the outer circumference of the needle 21*c* and is able to move up or down along a central axis of the needle 21*c*. The bug member 21*e* is made of a flexible material such as rubber and spring-loaded in a downward direction by a spring 21*d*.

Before an ink-supplying means 21 is connected to the ink inlet 20*b* of the reserve ink tank 20, the pore 21*b* of the needle 21*c* is covered by a bung member 21*e* as shown in FIG. 4. In this case, therefore, there is no leakage of ink from the needle 21*c* at this time. At this time, as shown in FIG. 4, the ink inlet 20*b* of the ink tank 20 formed by a flexible valve member such as rubber is being closed by the stability of the valve member to restore its original state.

On the other hand, as shown in FIG. 4, when an ink-supplying means 21 is connected to the ink inlet 20*b* of the reserve ink tank 20, the surface of the ink inlet 20*b* and the bottom of the bung member 21*e* are brought into intimate contact with each other. Furthermore, the bung member 21*e* moves upward against the force of the spring 21*b* to open the pore 21*b* of the needle 21*c* in the inside 20*c* of the inlet 20*b*. Subsequently, the ink flowed out from the pore 21*b* pass through flow channels 38, 39, and 40, and is absorbed by a sponge-like ink absorber 41 in the reserve ink tank 20.

D. [Configuration of the Capping Device Portion 30]

A capping device portion 30 makes good contact with the printing head 20*a* and sucks out foreign matter, such as air and thickened ink, which is the cause of the eject defect of the ink. In FIG. 5 and FIG. 6, the reference numeral 38*a* is a cap member which covers the surface on which ink eject ports of the printing head are formed (the ink eject port-formed surface). The reference numeral 54 is a cap member that makes good contact with the surface 53*a* on which a general suction port 53 is formed. The cap members 38*a,* 54 are held by a frame body 45, while the frame body 45 is supported by four link arm members 46 so as to allow the up-and-down movements of the frame body 45. The reference numeral 47 denotes a spring that pushes the frame body upward. In addition, the cap members 38*a,* 54 are connected to ducts 30*b,* 55, respectively. The ducts 30*b,* 55 are also connected to a change-over mechanism 56 for changing the pump suction ways.

D-1. [Change-over Mechanism 56 for Changing the Pump Suction Ways]

The projection part 45*a* located on the migration tracking of the bank part 19*a* held in the predetermined position of the carriage 19 is held at one end of the frame body 45. When a bank part 19*a* hits the projection part 45*a* at the position of moving the carriage 19, as shown in FIG. 3, the frame body 45 is pushed down against the force of the spring 47. As a result, the surface of the printing head 20*a* on which the ink eject ports are formed and the surface 53*a* on which the general suction port 53 passes through the tops of the cap members 38*a,* 54 without touching. When the bank part 19*a* leaves the projection part 45*a,* as shown in FIG. 6, the frame body 45 is raised by the spring 47. As a result, the cap member 38*a* makes good contact with the surface 53*a* on which the ink eject ports are formed and also the cap member 54 makes good contact with the surface 53*a* on which the general suction port 53 is formed.

The change-over mechanism 56 to be connected with the ducts 30*b,* 55 has a rotary valve 59 made of rubber as shown in FIG. 6. The rotary valve 59 connects the ducts 30*b,* 55 to the pump suction port 31*a* of the suction pump 31 through a passage 59*a* in a selective manner in response to the positions every time the rotary valve 59 is rotated at 90 degrees. As shown in FIG. 3, the rotary valve 59 is fixed on a rotational shaft 56*a* on which a saw-tooth gear 56*b* is co-axially placed. In addition, a proximal end of an arm member 56*c* is supported by the rotational shaft 56*a* so as to be able to rotate about the shaft 56*a* while a ratchet teeth 56*d* is pivoted on the other end thereof. The ratchet teeth 56*d* engages with the saw-teeth gear 56*b* in one direction only. The reference numeral 56*e* denotes a spring that pulls the arm member 56*c* in a clockwise direction in FIG. 3. Two location indication members 56*f* are provided and staggered 180 degrees apart on the saw-tooth gear 56*b*. The reference numerals 57, 58 are location sensors provided in place 90 degrees apart to detect the position of the location indication members 56*f*. Each of the location sensors 57, 58 may be a micro-switch, a photo-sensor, or the like.

The tip of the arm member 56*c* is coupled to a pore portion 34*b* of a selector lever 34 (see FIG. 2) through a coupling shaft 36. An end of the selector lever 34 is pivoted around an axial shaft 34*a*. If the carriage 19 touches the tip of the selector lever 34 by moving the carriage 19 in the direction of the arrow 35, and the carriage 19 further shifts its position in the same direction, the selector lever 34 turns around the axial shaft 34*a* in the direction of the arrow 35 to the position indicated by a broken line. Synchronizing the turn of the selector lever 34 in the direction of the arrow 35, the arm member 56*c* (see FIG. 3) turns 90 degrees in a counterclockwise direction in FIG. 3 against the force of the spring 56*e*. In this case, therefore, the ratchet teeth 56*d* engages with the saw-tooth gear 56*b,* so that the saw-tooth gear 56*b* turns 90 degrees in a clockwise direction with the rotational shaft 56*a* and rotary valve 59. After that, when the carriage 19 leaves from the tip of the selector lever 34 in the direction of the arrow 28, the selector lever 34 and the arm member 56*c* are turned in the clockwise direction for returning to their original positions by the force of the spring 56*e*. In this case, the ratchet teeth 56*d* does not engage with the saw-tooth gear 56*b,* so that the saw-tooth gear 56*b* does not rotate.

Figure 8:
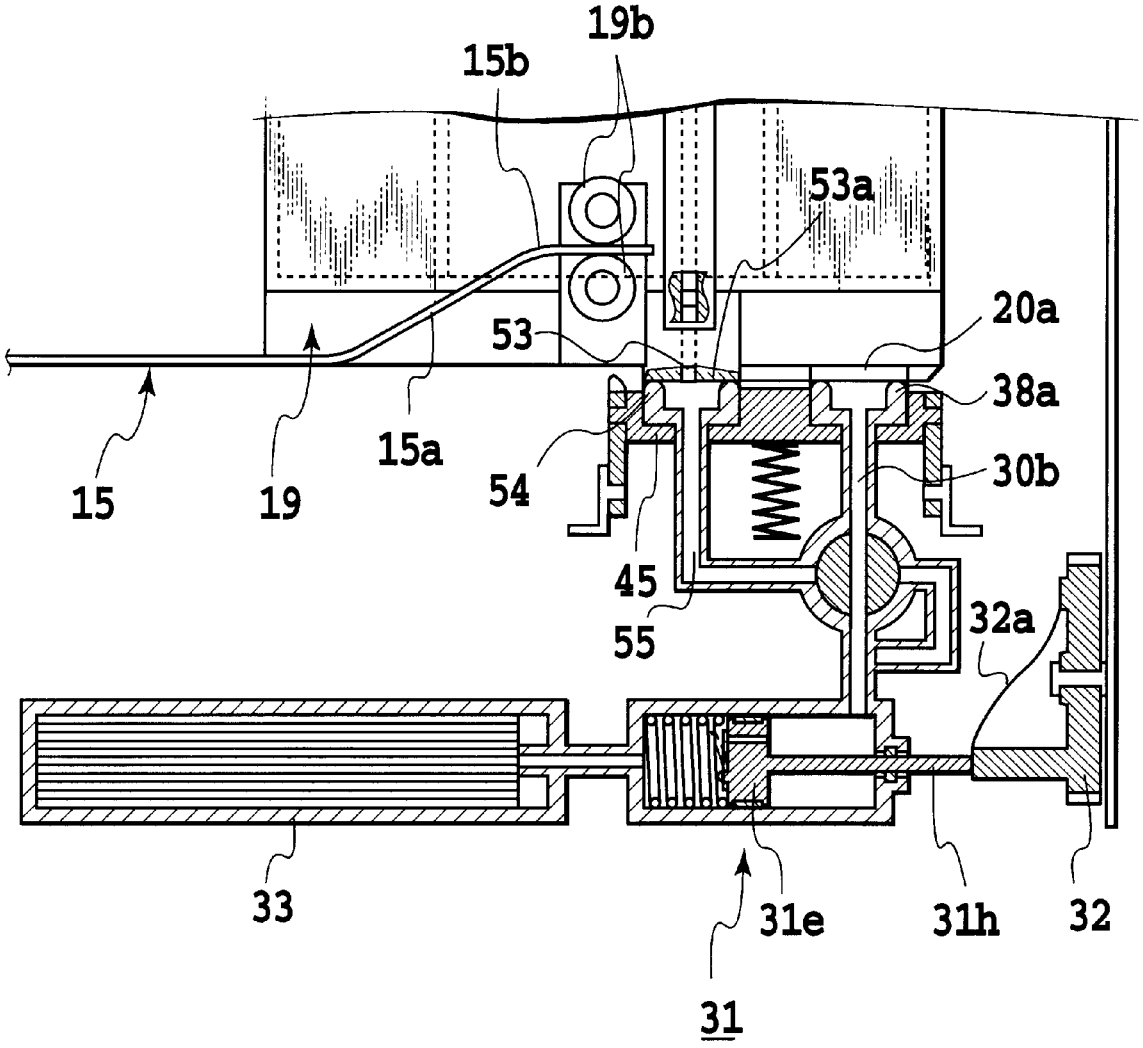
FIG. 8 is a partially cutaway cross sectional view of the air suction system shown in FIG. 3 while the printing head is subjected to the operation of recovering its function by suction.

Like this, every time the carriage 19 turns the selector lever 34 in the direction of the allow 34, the rotary valve 59 is rotated by 90 degrees of a turn in a counterclockwise direction to switch from one of the pump suction ways to another. The condition of switching between the pump suction ways is detected by the location sensors 57, 58. FIG. 6 illustrates the state of switching between the pump suction ways when the location sensor 57 detects the location indication member 56*f*. Then, the general suction port 53 communicates with the pump 31 through the cap member 54, the duct 55, the passage 59*a,* the pump suction port 31*a*. On the other hand, FIG. 8 illustrates the state of switching between the pump suction ways when the location sensor 58 detects the location indication member 56*f*. Then, the ink eject ports of the printing head 20*a* communicate with the pump 31 through the cap member 38*a,* the duct 30*b,* the passage 59*a,* and the pump suction port 31*a*. A control means 25 (see FIG. 1) to be described later confirms the states of switching the pump suction ways on the basis of detection signals from the location sensors 57, 58. If the state of switching between the pump suction ways is not appropriate to the operation to be down, the control means 25 allows the movement of the carriage 19 in the direction of the arrow 35 and the turn of the selector lever 34 in the direction of the allow 34. Consequently, the switching between the pump suction ways is down so as to be fit to the desired operation.

In FIG. 1, the reference numeral 24 denotes an electric substrate arranged in the inside of the cover 4 having a plurality of switch buttons 23 that project upward through the holes formed on the cover 4. The reference numeral 25 denotes a control means that comprises a microcomputer, a memory, and so on mounted on a control electric substrate arranged in the inside of the cover 4. The control means 25 controls the functions of the printing apparatus in communication with a host computer.

D-2. [Suction Pump 31]

As shown in FIG. 6, the suction pump 31 comprises a piston member 31*e* which is co-axially provided in a cylinder member 31*c* having a suction inlet 31*a* and an outlet 31*b*. In addition, a seal member 31*d* is placed between the piston member 31*e* and the cylinder member 31*c*. The piston member 31*e* is able to perform a reciprocating motion in the cylinder member 31*c*. A pore 31*f* provided in the piston member 31*e* has a reed valve 31*g* that restricts the flow of ink only to the one-way (i.e., the left side of FIG. 6). Furthermore, the reference numeral 31*h* is a piston shaft that actuates the piston member 31*e,* and 31*i* denotes a spring member that pushes the piston member 31*e* to the right side of FIG. 6. Ink and air absorbed by such a suction pump 31 pass from the outlet 31*b* to the discharge pipe 31*j*. Then, they are discharged toward the sponge-like ink absorber 33*a* in a liquid waste container 33.

The piston shaft 31*h* performs a reciprocating motion in the left-right direction of FIG. 6 in response to the turn of a cam part 32*a* of a cam gear 32 to be described later. The piston member 31*e* performs a reciprocating motion in the left-right direction in synchronization with the movement of the piston shaft 31*h*, so that air and ink absorbed from the suction port 31*a* are discharged to the outlet 31*b*.

As shown in FIG. 4, a gear 56 is installed on the shaft 13*a* of the transport roller 13 through a one-way clutch 13*b*. The gear 56 can be rotated by a drive motor 60. If a drive shaft of the drive motor 60 is rotated counterclockwise, the shaft 13*a* of the transport roller 13 is rotated. If the drive shaft of the drive motor 60 is rotated clockwise, the cam gear 32 is rotated. The cam gear 32 has a cam part 32*a* that touches the piston shaft 31*h* by the force of the spring 31*i*. The location where the cam part 32*a* touches the piston shaft 31*h* changes in response to the turning of the cam gear 32. As a result, the piston shaft 31*h* is moved right and left as a reciprocating motion. Also, the piston member 31*e* is moved right and left as a reciprocating motion in conjunction with the piston shaft 31*h*. If the piston member 31*e* moves toward the light side, the valve 31*g* is closed by a pressure generated in a pressure chamber 31*k* on the left side to exhaust ink and air in the pressure chamber 31*k* from the outlet 31*b* to the liquid waste container 33. Moreover, the volume of a pressure chamber 31*m* on the right side is increased, and simultaneously negative pressure is generated in the pressure chamber 31*m*. The negative pressure allows the suction of ink and air from the suction port 31*a*. On the other hand, ink and air in the pressure chamber 31*m* on the right side are moved to the pressure chamber 31*k* on the left side by passing through the pore 31*f* when the piston member 31*e* is moved to the right side.

Next, the actuation of the printing apparatus will be described.

(Printing Movement)

The image data to be transmitted to a printing device portion 2 from a host computer is expanded on the occasion of the printing movement. The control means 25 controls the movement of the carriage 19 in the main-scanning direction, the transport of the printing medium S by a pair of the transport rollers 13, 14 in the sub-scanning direction, and the actuation of the printing head 20*a*. The printing head 20*a* prints a color image on the printing medium S by ejecting ink droplets of each color using nozzles 44 being controlled on the basis of the process of gradating an image (the procedures of overlaying color dots).

The photosensor 12 detects the end of the printing medium S. After performing the printing movement on the end of the printing medium S, a pair of rollers 14 rotates to discharge the printing medium S on which an image is printed from the outlet 4*b*.

(Recovery Action)

When the power of the printing apparatus turns on, or the printing movement is not operated during more than predetermined time after the power of the printing apparatus turns on, the control means 25 allows an automatically start of the recovery action to get rid of thickened ink or air bubbles formed in the nozzles of the printing head 20*a*. If the printed image has some color faint, inconsistencies in density, or the like, the control means 25 starts the recovery action in the same way by pushing predetermined control buttons (see FIG. 1).

On the occasion of the recovery action, at first, the control device 25 confirms whether the location sensor 58 in the mechanism 56 that switches between suction ways is in the state of detecting the location indication member 56*f*. If the location indication member 56*f* is detected by the location sensor 57, the carriage 19 is moved in the direction of the arrow 35 (the left side direction) so that the selector lever 34 turns in the direction of the arrow 35. Consequently, it becomes the condition of detecting the location indication member 56*f* by the location sensor 58 (i.e., the condition of switching between the suction ways as shown in FIG. 8). The control means 25 confirms that it is in the state that the location sensor 58 detects the location indication member 56*f*. After that, as shown in FIG. 5, FIG. 7, and FIG. 8, the carriage 19 is moved so that the cap member 38*a* touches the printing head 20*a* and the cap member 54 touches the general suction port 53. Subsequently, the control means 25 rotates the cam gear 32 by running a motor 60 (see FIG. 4) in the clockwise direction through the gear 59. Consequently, the suction pump 31 absorbs thickened ink and air in the nozzles 44 of the printing head 20*a* and discharges them into the liquid waste container 33.

The piston member 31*e* of the suction pump 31 does the actuation of one cycle of the absorption and the discharge by a turn of the cam gear 32. The number of rotate of the cam gear 32 depends on the magnitude of the essential negative pressure for the recovery of the eject defect of the printing head 20*a*.

(Ink-supplying Movement)

The number of ink droplets ejected by the printing head 20*a* is counted with the control means 25 in each ink color. If at least one of the count value of each ink color meets a predetermined number, when the printing movement to the printing medium S is completed, and so the printed printing medium S is ejected from the printing apparatus, the control means 25 starts to actuate the ink-supply to the reserve ink tank 20 from the supplementary ink tank 22 (see FIG. 1).

The control means 25 confirms whether it is in the condition that the location sensor 57 in the suction-way switching mechanism 56 detects the location indication member 56*f*. When the location indication member 56*f* is detected by the location sensor 58, the selector lever 34 is turned in the direction of the arrow 35 by moving the carriage 19 in the direction of the arrow 35 (the left side). Consequently, it becomes the condition that the location sensor 57 detects the location indication member 56*f*, that is, the condition of switching between the suction ways as shown in FIG. 6. The control means 25 confirms that it is in the state that the location sensor 57 detects the location indication member 56*f*. After that, as shown in FIG. 5, FIG. 6, and FIG. 7, the carriage 19 is moved so that the cap member 38*a* touches the printing head 20*a* and the cap member 54 touches the general suction port 53. Subsequently, the control means 25 rotates the cam gear 32 by running a motor 60 (see FIG. 4) in the clockwise direction through the gear 59. Consequently, the suction pump 31 absorbs air in the reserve ink tank 20 through the gas-permeable member 48, and ejects them into the liquid waste container 33.

The inside of the reserve ink tank 20 becomes negative pressure as a result of absorbing air in the reserve ink tank 20 by the suction pump 31. At this time, as shown in FIG. 7, the supply means 21 connects the supplementary ink tank 22 (see FIG. 1) to the reserve ink tank 20. Therefore, ink in the supplementary ink tank 22 is absorbed into the inside 41 of the reserve ink tank 20 by the negative pressure in the reserve ink tank 20. The ink being entered into the inside 41 of the reserve ink tank 20 permeates an ink absorber 41*a* that consists of a cluster of small cells that communicate with each other. Thus, a liquid level 41*b* of the ink rises as the ink permeates the ink absorber 41*a*. The rise rate of the liquid level 41*b* of the ink is adjusted properly on the basis of rotational frequency of the cam gear 32 as it depends on the suction force of the suction pump 31. If the liquid level 41*b* of the ink reaches the gas-permeable member 48, the supply of ink is automatically stopped because the gas-permeable member 48 does not permeate a fluidal material such as ink. Ink is supplied from the supplementary ink tanks 22 (22Y, 22M, 22C, 22B) to the respective reserve ink tanks 20 (20Y, 20M, 20C, 20B) at the same time. Then, the supply of ink to the reserve ink tanks 20 (20Y, 20M, 20C, 20B) is automatically stopped one after another in order of reaching the liquid level 41*b* of the ink to the gas-permeable member 48. If the supply of ink is completed, the control means 25 resets the counter of ejected ink droplets to zero for each of ink color.

Thus, air in all of the reserve ink tanks 20 (20Y, 20M, 20C, 20B) can be absorbed through the use of a single cap member 54 and simultaneously refilled. Therefore, there is no need to provide a suction port 53*b* and a cap member 54 for each of the reserve ink tanks 22 (22Y, 22M, 22C, 22B), so that both the size and weight reductions of the structural components of the capping device portion 30 on the side of the carriage 19 are achieved. In addition, the reliability of a device area that makes the reserve ink tanks 20 (20Y, 20M, 20C, 20B) negative pressure can be secured.

The reserve ink tank 20 is inclined at an angle as shown in FIG. 7 during the step of supplying ink, so that an area 41*c* where ink is not absorbed is found in an ink absorber 41*a* in the inside 41 of the tank 20. After the supply of ink, the reserve ink tank 20 gets back to a horizontal position as shown in FIG. 4. In this case, ink permeates through the area 41*c* of the ink absorber 41*a*. Thus, the liquid level 41*b* of ink over the surface of the gas-permeable member 48 as shown in FIG. 7 moves downward and leaves from the surface of a gas-permeable member 48 as shown in FIG. 4. If there is a possibility that the gas-permeable member 48 permeates ink as a result of its decreased function when it is being touched ink, as the characteristics of the gas-permeable member 48, it is effective to leave ink from the surface of the gas-permeable member 48 all the times except the time of supplying ink.

By the way, the suction pump 31 of the present embodiment combines the function as an absorbing means to absorb ink for the recovery operation to the printing head 20*a* with another function as an absorbing means to absorb air in the reserve ink tank 20 for the supply of ink. Therefore, the present embodiment is able to provide a substantially simplified and low-cost printing apparatus, compared with the one having a plurality of suction pumps for those functions. Furthermore, negative pressure to be applied on the inside of the reserve ink tank 20 during the period of supplying ink is adjusted to a predetermined level in order to prevent a backward current of ink from the nozzles 44 to the reserve ink tank 20 when the ink eject ports are being opened. During the period of supplying ink, the ink eject ports may be sealed with the cap member.

In addition, if air is introduced into an ink flow path between the reserve ink tank 20 and the supplementary ink tank 22 from a port of the ink flow path, the air can be discharged through the gas-permeable member 48 and subsequently the supply of ink can be carried on. Ink is supplied under suction by means of negative pressure in the reserve ink tank 20. Therefore, ink can be supplied even if there is a difference between the height of a head of the ink in the reserve ink tank 20 and the height of a head of the ink in the supplementary ink tank.

If ink is supplied under suction without using the gas-permeable member 48, the following programs are caused. When air intrudes into the reserve ink tank 20 from the nozzle 44, meniscus of ink must be formed on the ink eject port while the intruded air must be discharged from the reserve ink tank 20 by absorbing ink again from the nozzle 44 after the action of supplying ink. Therefore, useless waste ink is produced with taking unnecessary time. If a space is present in the cap even if the nozzle 44 is being sealed with the cap as the action of supplying ink is performed, air in such a space intrudes into the reserve ink tank 20 through the nozzle 44 to cause the same kind of trouble.

[Second Preferred Embodiment]

FIGS. 9 to 17 illustrate an second preferred embodiment of the present invention.

Figure 9:
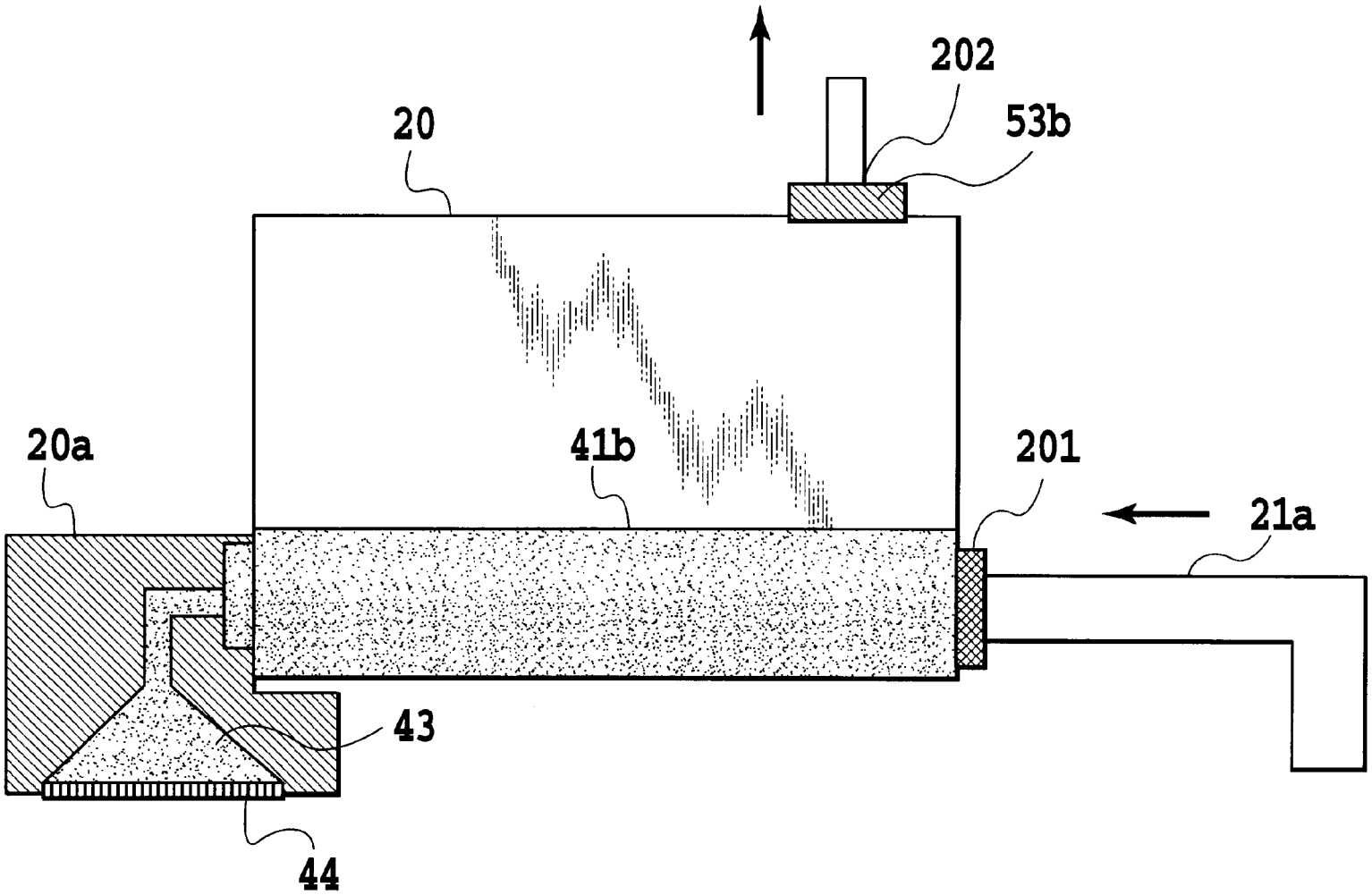
FIG. 9 is an exploded view of the ink tank in accordance with the second embodiment of the present invention.
Figure 10:
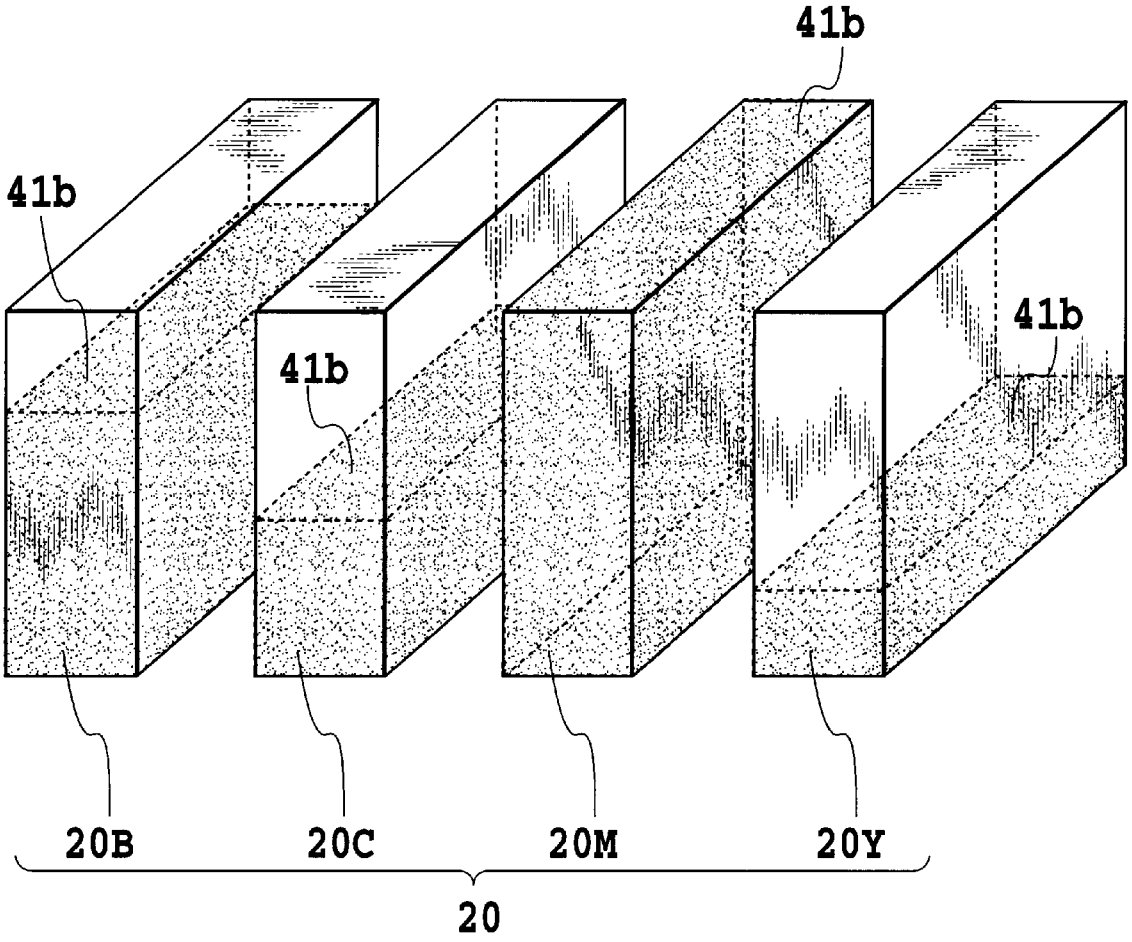
FIG. 10 is a perspective view of the ink tank shown in FIG. 9.
Figure 11:
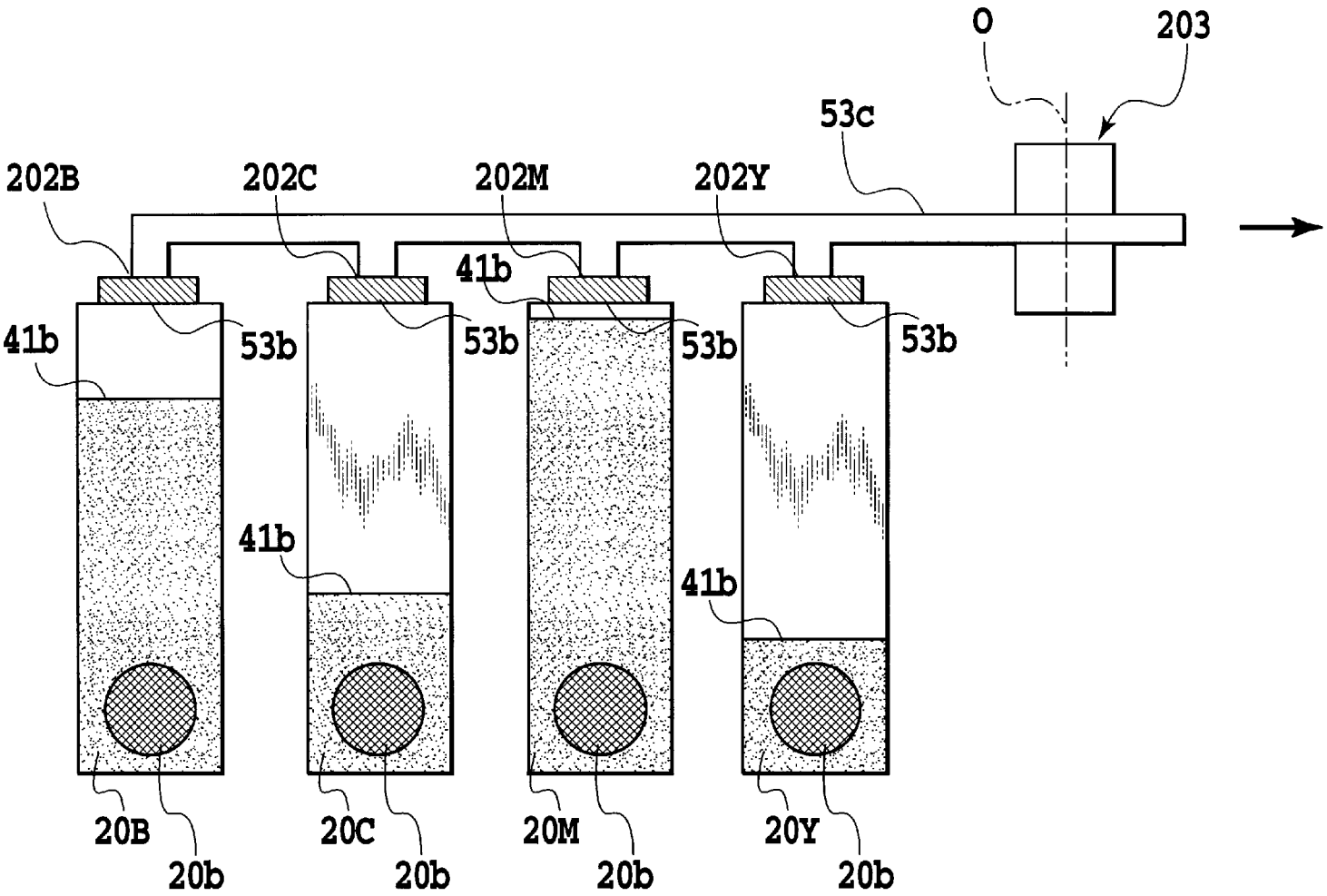
FIG. 11 is an explanatory view that illustrates the air suction system to be connected to the ink tank of FIG. 9.

In this embodiment, as shown in FIG. 9, an ink inlet 20*b* and a suction port 53*b* are formed on each of the reserve ink tanks 20Y, 20M, 20C, and 20B of FIG. 10. Each suction port 53*b* has the same gas-permeable member (not shown) as that of the first embodiment described above. In the figure, the reference numeral 201 denotes a supply joint for each type of ink. The supply joint 201 is configured to make a connection to each ink inlet 20*b*, and connected to the same ink supply system as that of the first embodiment described above. The reference numeral 202 denotes a suction joint configured to make connection to each suction port 53*b* as shown in FIG. 11. All suction joints 202 (i.e., 202B, 202M, 202Y, and 202C) are gathered into the suction passage 53*c* and then connected to the same ink suction system as that of the first embodiment described above.

Figure 13:
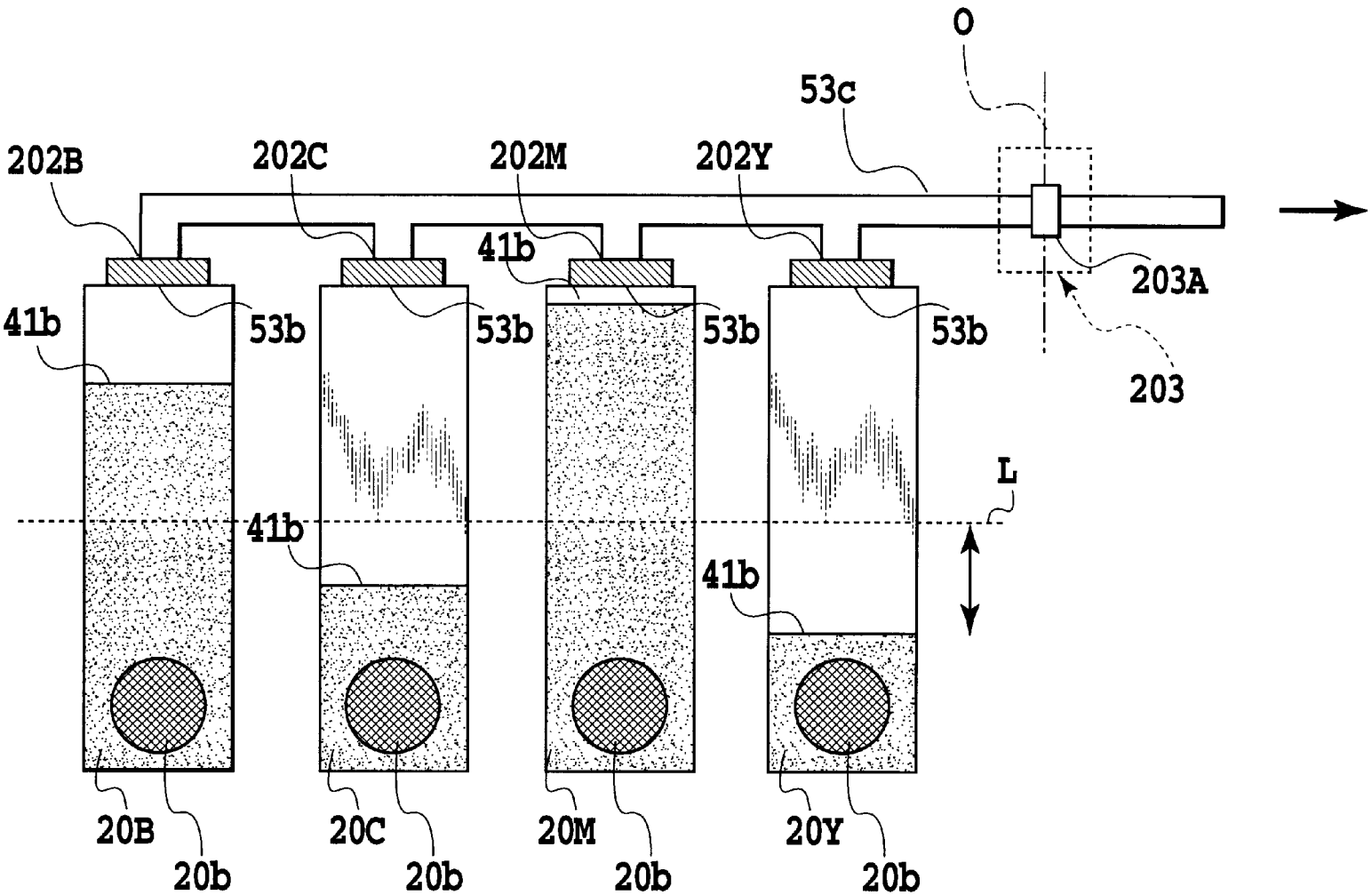
FIG. 13 is an explanatory view that illustrates the status of the air suction system before the supply of ink to the ink tank of FIG. 9.
Figure 14:
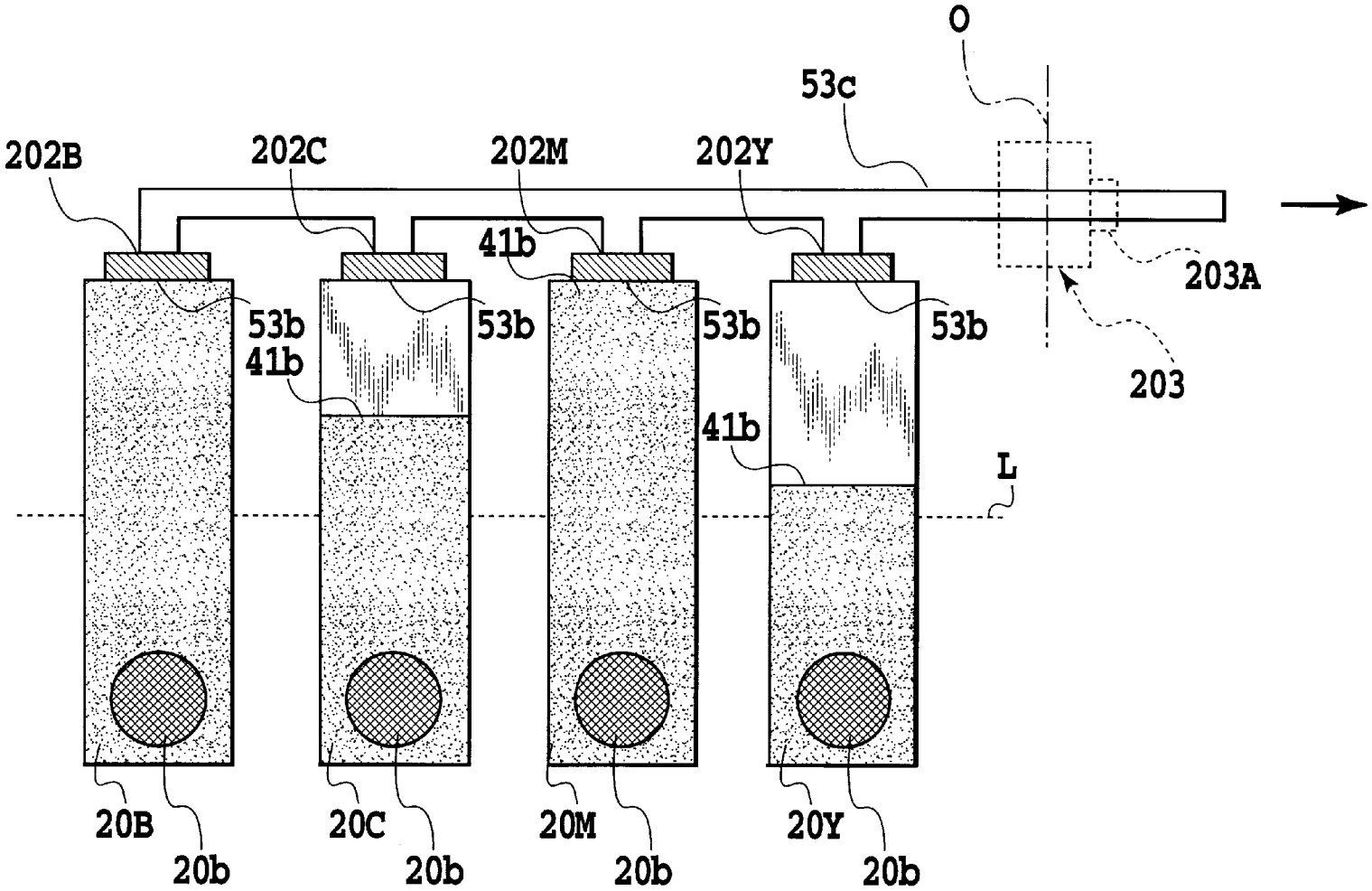
FIG. 14 is an explanatory view that illustrates the status of the air suction system at the time of supplying ink to the ink tank of FIG. 9.

The letter "L" in FIG. 13 represents a detection reference level for detecting the level 41*b* of ink. A means for detecting the level 41*b* of ink may be an electric level sensor, an optical level sensor, or the like. The electric level sensor detect the level 41*b* due to the existence of ink between electrodes placed in the reserve ink tank 20. The remaining amount of ink in the reserve ink tank 20 may be estimated by obtaining the amount of ink consumed on the basis of the number of ink-eject from the printing head 20*a*. The remaining amount of ink may be detected in each of the reserve ink tanks 20Y, 20M, 20C, and 20K.

Figure 12A:
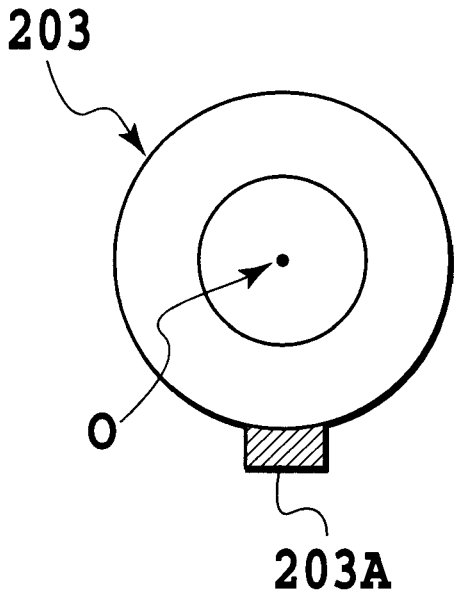
FIG. 12A is a front view of the stopper shown in FIG. 11.
Figure 12B:
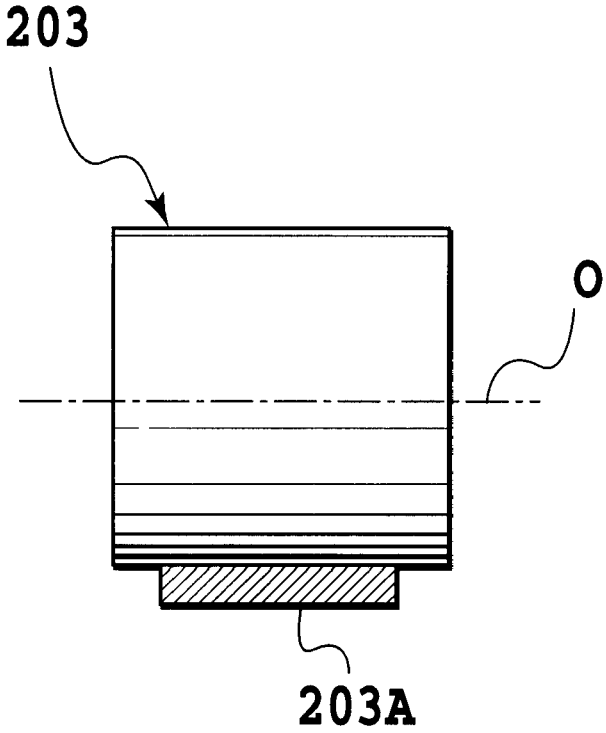
FIG. 12B is a side view of the stopper.

The suction passage 53*c* has a stopper 203 as a means for closing or opening the suction passage 53*c*. In addition, a stopper portion 203A is formed on an outer peripheral surface of the stopper 203 as shown in FIG. 12A and FIG. 12B. If the stopper 203 rotates about its central axis "O" so that the stopper portion 203A faces the suction passage 53*c*, as shown in FIG. 13, the stopper portion 203A presses and closes the suction passage 53*c*. If the stopper 203 rotates about its central axis "0" so that the stopper portion 203A is detached from the suction passage 53*c*, the suction passage 53*c* returns to its original open state.

During the action of supplying ink to the reserve ink tanks 20Y, 20M, 20C, and 20K, the suction passage 53*c* is opened at first. Then, negative pressure is caused in each ink tank 20 from the suction port 53*b* through the gas-permeable member as in the case of the embodiment described above. The negative pressure allows the supply of ink through the ink inlet 20*b*. Hereinafter, the process including these steps is so-called "the action of supplying ink". The action of supplying ink allows the concurrent supply of ink to the reserve ink tanks 20Y, 20M, 20C, and 20K. The stopper 203 closes the suction passage 53*c* except when the action of supplying ink is currently progress.

Figure 17:
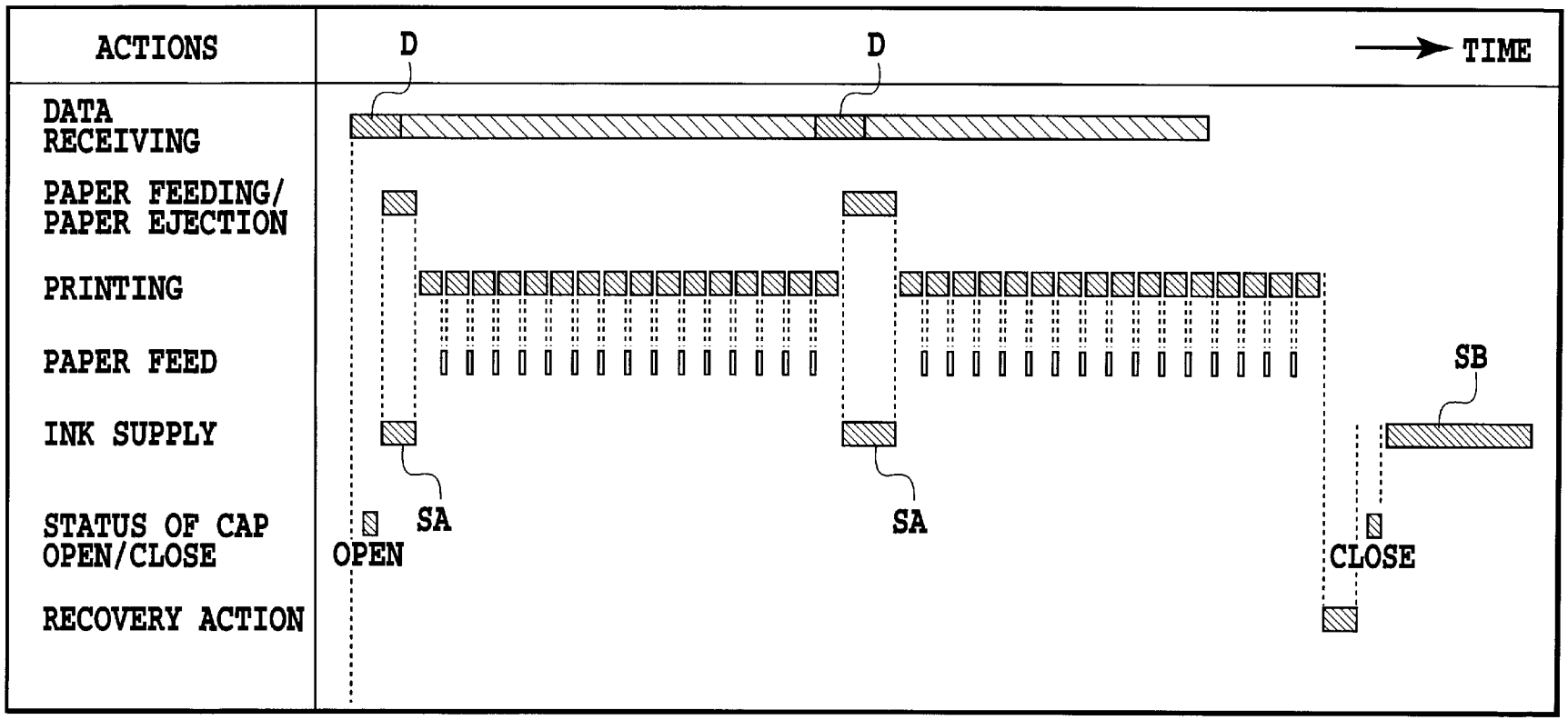
FIG. 17 is a timing chart for illustrating the action of supplying ink to the ink tank of FIG. 9.

FIG. 17 is a timing chart for illustrating a series of actuation of the printing apparatus. At first, the printing apparatus receives printing data "D" corresponding to one page of the printing medium. Then, the printing apparatus repeats the steps of: performing the printing movement for printing one line of the image by moving the printing head 20*a* in the main-scanning direction after the action of providing the printing medium; and feeding the printing medium for one line of the image. After the image printing, the printing medium is discharged from the printing apparatus and then the next printing medium is provided to perform the next printing movement. The action of capping shown in FIG. 17 is for the printing head 20*a*. In advance of starting the printing movement, a-capping means is detached from the printing head 20*a,* bringing about its "OPEN" state (hereinafter, also referred to as a "cap-open" state), and then the capping means is attached to the printing head 20*b* after performing a series of steps in the printing movement, bringing about its "CLOSE" state (hereinafter, also referred to as a "cap-close" state). In addition, the recovery action is performed prior to the cap-close state, which makes the printing head 20*a* eject a predetermined amount of ink without contributing to any image formation. The recovery movement may include the action of discharging ink from nozzles 44 of the printing head 20*a* under suction, the action of primary eject of ink from the printing head 20*a,* or the like. The supply of ink shown in FIG. 17 is the action of supplying ink described later, which can be performed every time after printing an image on one page of the printing medium.

Figure 15:
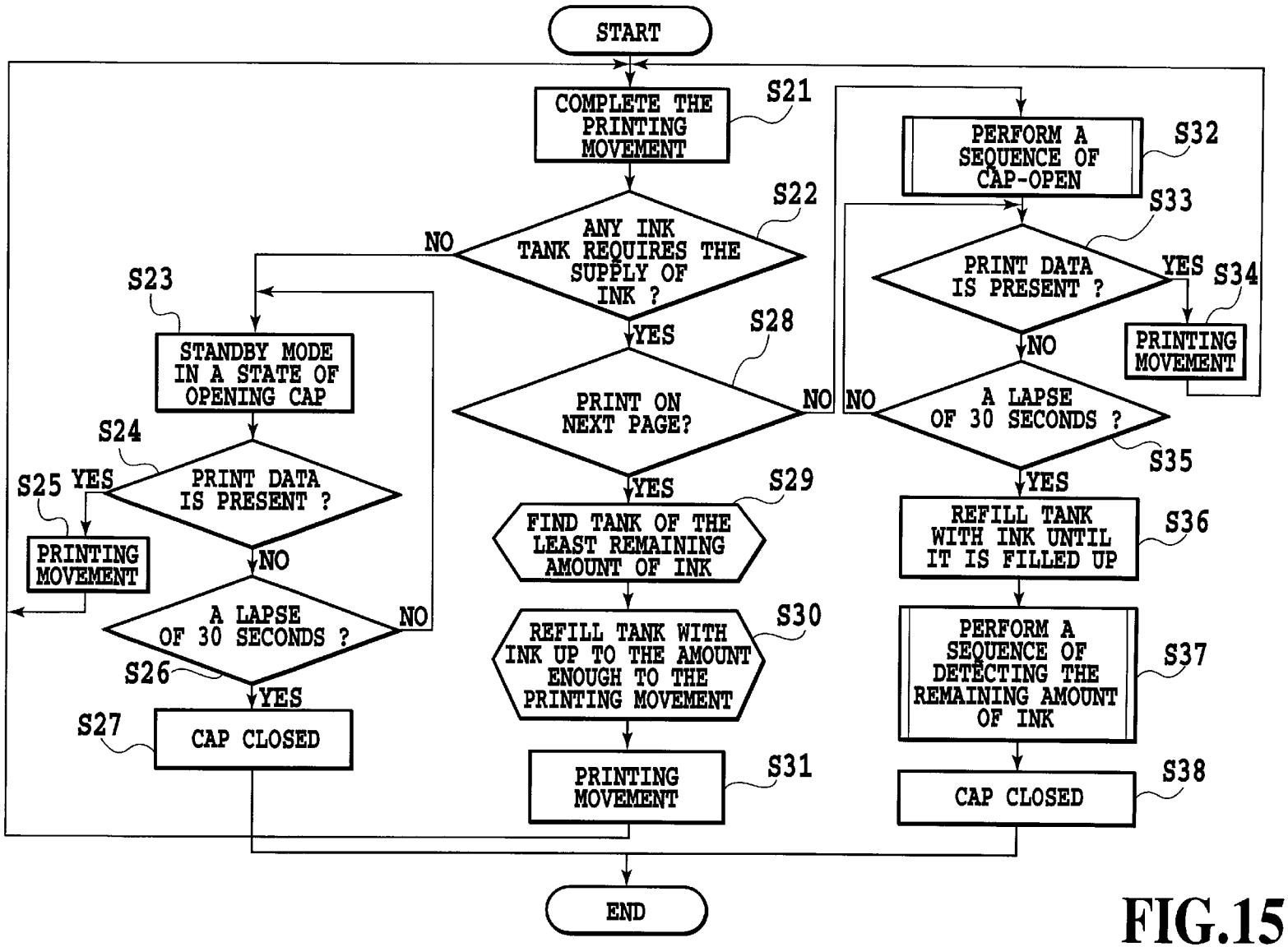
FIG. 15 is a flow chart for illustrating the action of ink supply to the ink tank of FIG. 9.

FIG. 15 is a flow chart for illustrating the action of supplying ink.

After the printing movement by one page of the printing apparatus, the printing apparatus detects the remaining amount of ink in each of the reserve ink tanks 20Y, 20M, 20C, and 20K. Subsequently, it judges whether the remaining amount of ink is decreased to a predetermined level by which it becomes necessary to supply the required amount of ink on the basis of the results of such a detection (steps S21, S22). In this embodiment, such a judgement is based on a rule that the need for supplying ink arises when the level 41*b* of ink is lowered than a predetermined level "L".

If the supply of ink is not required, the printing apparatus is kept in the cap-open state (step S23) or performs the printing movement when it receives printing data "D" (steps S24 and S25). If the printing data "D" is not received even if fixed time has elapsed (step S26), it is switched to a cap-close state (in this embodiment, after lapse of 30 seconds) (step S27) to complete to sequence.

If the supply of ink is required, it is judged whether there is a need for printing the next page (step S28). The ink tank having the minimum remaining amount of ink is judged from the reserve ink tanks 20Y, 20M, 20C, and 20K at the time of printing the next page (i.e., at the state of ink-supply "SA" in FIG. 17). In the case shown in FIG. 13, the reserve ink tank 20Y is judged as the one having the minimum remaining amount of ink. Thus, the ink tank having the minimum remaining amount of ink receives the supply of ink until it is filled up to a predetermined target remaining amount of ink enough to perform the printing movement (step S30). The target remaining amount of ink may be defined as the amount of ink that corresponds to the predetermined level "L" of ink. Moreover, the target remaining amount of ink may be also defined as the minimum amount of ink to be required for printing an image on the next one page. Depending on the types (e.g., colors) of ink, the ink tanks may have their respective target remaining amounts of ink. In each reserve ink tank, the supply of ink to the ink tank filled up with ink is automatically stopped by means of the gas-permeable member during the action of supplying ink. In the case shown in FIG. 14, the actions of supplying ink to both the reserve in ink tanks 20M, 20B are automatically stopped. Following such an action of supplying ink, the next printing movement for one page is performed (step S31).

Figure 16A:
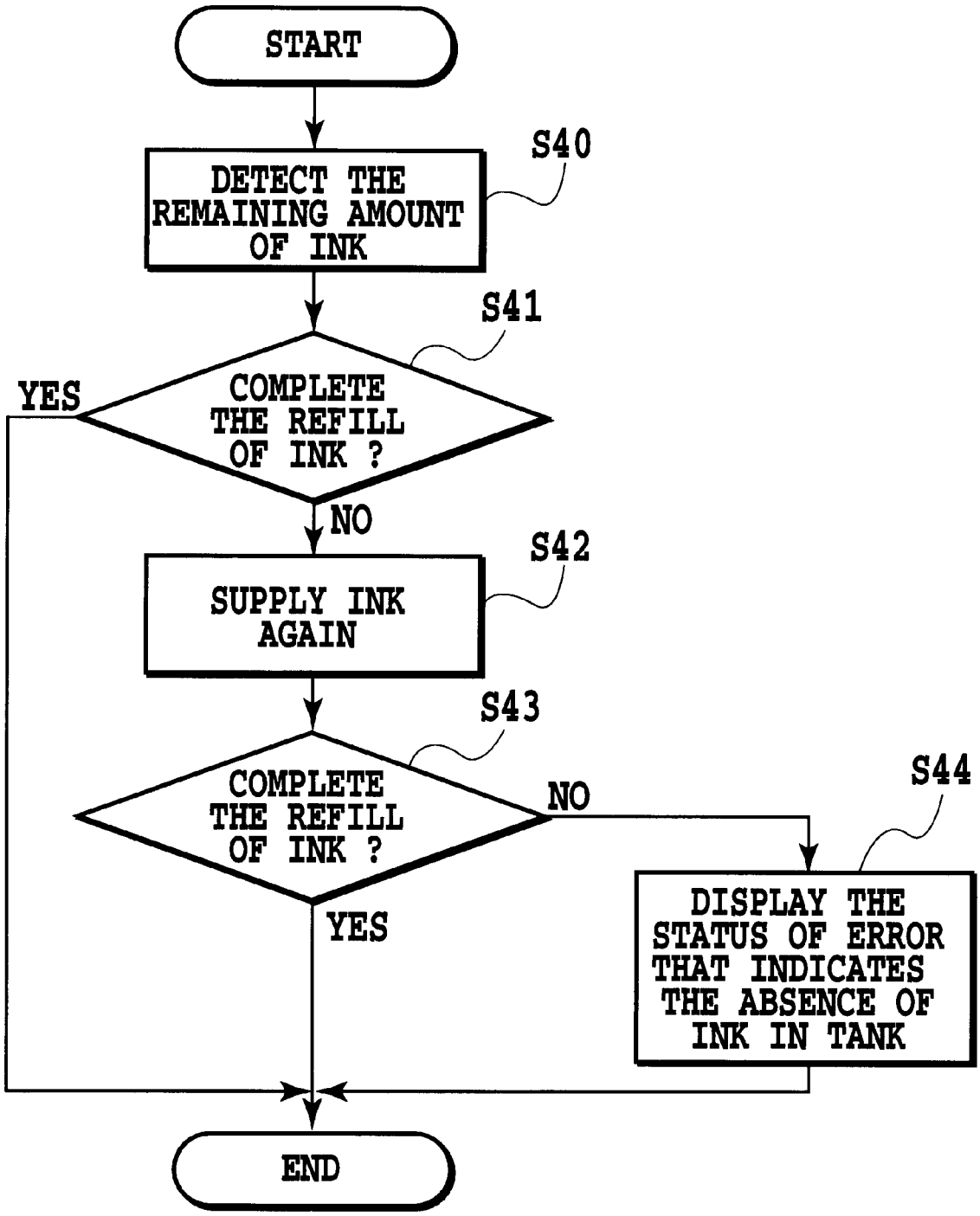
FIG. 16A is a flow chart for illustrating the sequence of detecting the remaining amount of ink in the ink tank and FIG. 16B is a flow-chart for illustrating the capopen sequence.
Figure 16B:
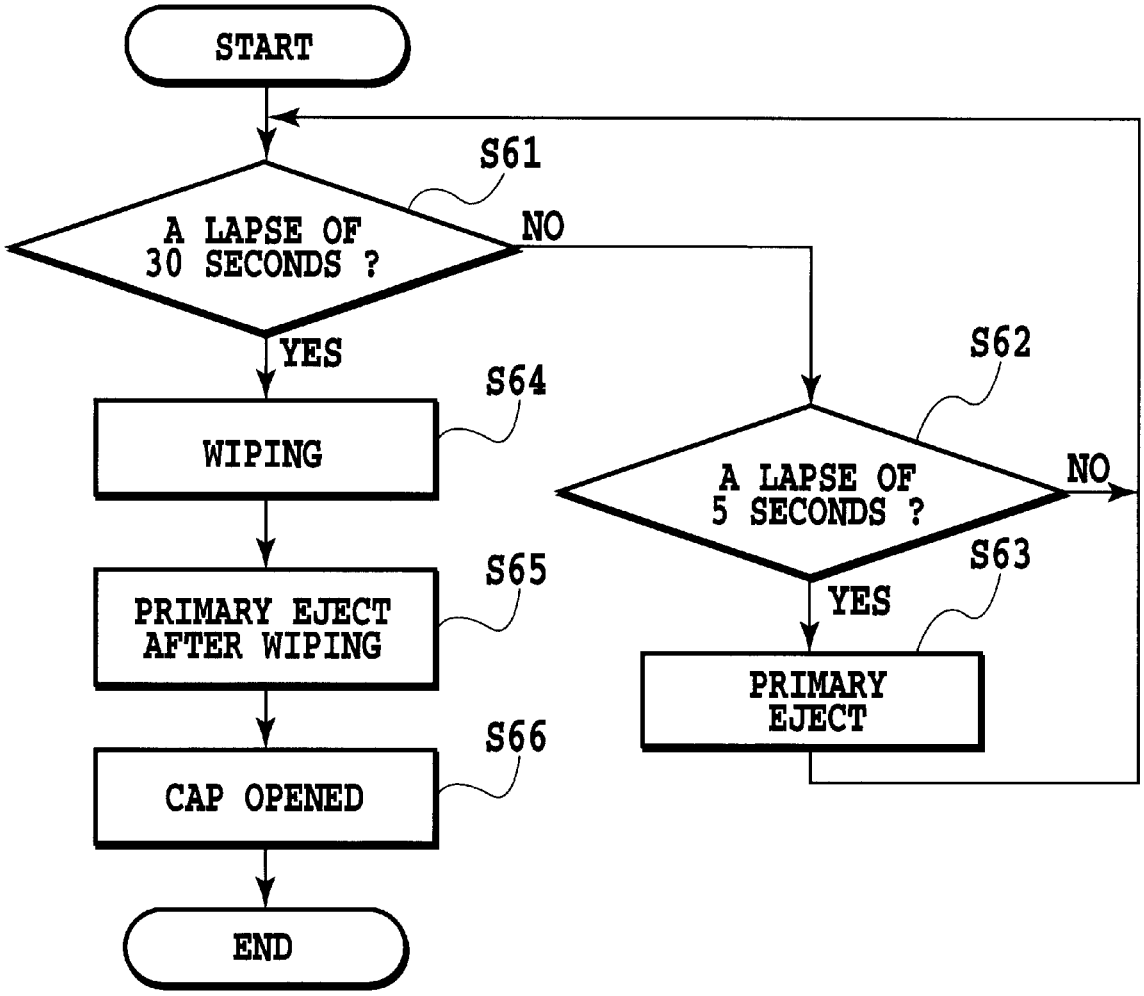

On the other hand. if the next printing movement for one page is not performed (i.e., if the supply of ink is performed during the period "SB" shown in FIG. 17), a sequence of the cap-open shown in FIG. 16B is executed (step S32). That is, the printing head 20*a* ejects ink which is not responsible for any image formation (primary eject) every five seconds until a predetermined time interval is expired (in this embodiment, 30 seconds) (steps S61, S62, S63). After a lapse of 30 seconds, the printing head 20*a* is subjected to the step of wiping (step S64) and the step of primary eject (step S65), followed by the step of cap-close (step S66) to complete the sequence.

After that, the printing head 20*b* waits a predetermined time interval (in this embodiment, 30 seconds) for the input of the printing date "D" (step S33). If the printing head receives the printing data "D" within the predetermined time interval, the printing movement is performed (step S34). If it does not receive the printing data "D" within the predetermined time interval (step S35), each of the reserve ink tanks 20Y, 20M, 20C, and 20K is filled with ink by the action of supplying ink (step S36). The supply of ink to each of the reserve ink tanks 20Y, 20M, 20C, and 20K is automatically stopped in order of being filled up with ink. Following the step of supplying ink to fill up the respective reserve ink tanks 20Y, 20M, 20C, and 20K, a sequence for detecting the remaining amount of ink in each of them (step S37) described later is performed and then completed after the cap-close (step S38).

In this way, if the next printing movement for one page is not performed, the reserve ink tanks 20Y, 20M, 20C, and 20K are filled up with ink respectively during the period after the printing movement without imposing a severe time limit. After that, the printing movement can be started at one because the reserve ink tanks 20Y, 20M, 20C, and 20K are being filled up with ink at the time of rebooting the printing apparatus. During the period in which the printing apparatus is not used, furthermore, the adhesion of ink in the reserve ink tank 20 can be prevented by keeping the reserve ink tank 20 in a state of being filled up with ink.

FIG. 16A is a flow chart for illustrating a sequence of detecting the remaining amount of ink in the reserve ink tank 20.

First, the sequence is switched on (step S40) and then starts to judge whether the charge of ink into the respective reserve ink tanks 20Y, 20M, 20C, and 20K is completed (step S41). If the charge of ink is not completed, the same action of aspirating ink as that of the step S36 is performed (step S42). Subsequently, it is judge again whether the charge of ink is completed (step S43). If the charge of ink is completed, the sequence is terminated. If it is not completed, it is judged that the main-tank (refill ink tank) to be used for supplying ink to the reserve ink tank 20 is empty and then an error is represented on a display means (not shown) (step S44).

In the present embodiment, by the way, the reserve ink tank 20 may be always connected to the ink-supplying system and the air-suction system.

[Third Preferred Embodiment]

FIG. 18 to FIG. 22 are explanatory views of a third preferred embodiment of the present invention.

Figure 18:
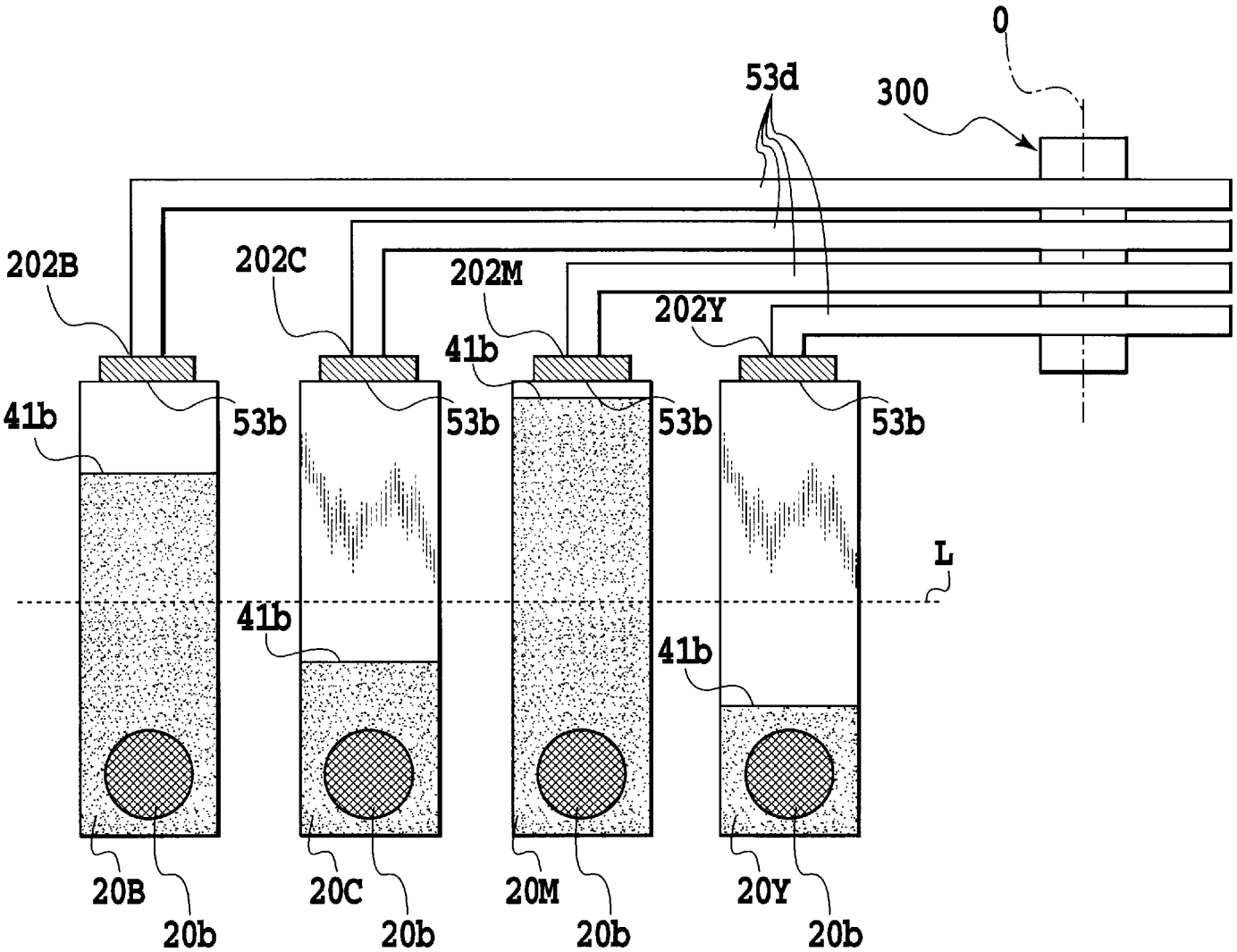
FIG. 18 is a schematic structural view of the air supply system to be connected to the ink tank in accordance with the third embodiment of the present invention.

In this embodiment, each of the reserve ink tanks 20Y, 20M, 20C, and 20B has its own ink inlet 20*b* and suction port 53*b* as shown in FIG. 18. The reference numeral 201 denotes a supply joint to be connected to the ink inlet 20*b* of the ink tank. Every supply joint 201 corresponds to its own ink tank with specific ink color. The supply joint is connected to an ink-supplying system just as in the case of the embodiment described above. The reference numeral 202 denotes a suction joint to be connected to each of the suction ports 53*b*. The suction joint 202 is connected to a suction system by an individual suction passage 53*d* just as in the case of the embodiment described above.

The letter "L" in FIG. 18 represents a detection standard level of the height (level) 41*b* of ink in the reserve ink tank 20. A means for detecting the level 41*b* of ink may be an electric level sensor or an optical level sensor. The electric level sensor detect the level 41*b* of ink due to the existence of ink between electrodes placed in the reserve ink tank 20. The remaining amount of ink in the reserve ink tank 20 may be estimated by counting the number of ejecting ink. The remaining amount of ink is estimated for each of the reserve ink tanks 20Y, 20M, 20C, and 20K.

Figure 19A:
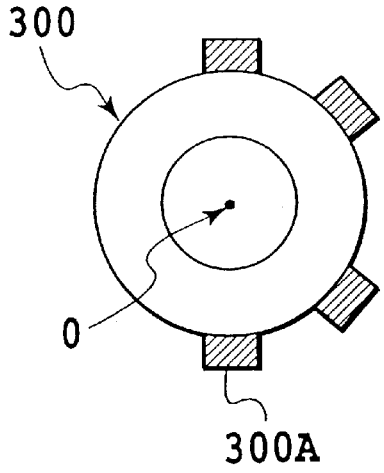
FIG. 19A is a front view of the stopper shown in FIG. 18.
Figure 19B:
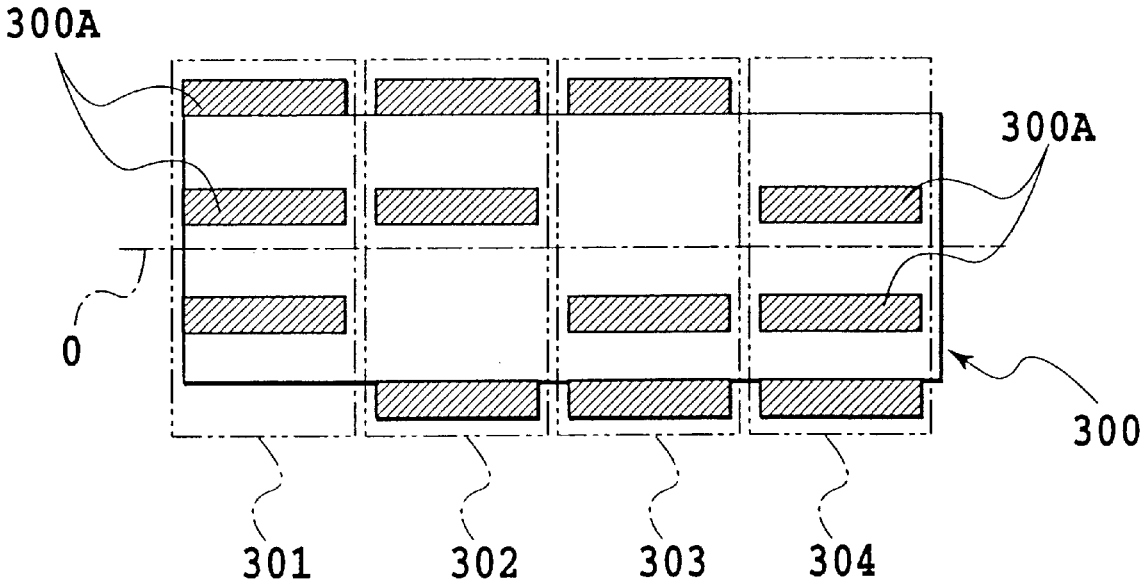
FIG. 19B is a side view of the stopper.

Each of the suction passages 53*d* is provided with a stopper 300 as a means for opening or closing the suction passage 53*d*. In addition, a plurality of stopper portions 300A are formed on an outer peripheral surface of the stopper 300 as shown in FIG. 19A and FIG. 19B. In this embodiment, the stopper portions 300A are grouped into four different stopper groups in the direction of the radius of the stopper 300, i.e., a first stopper group 301, a second stopper group 302, a third stopper group 303, and a fourth stopper group 304, which correspond to their respective suction passages 53*d* of the reserve ink tanks 20Y, 20M, 20C, and 20K, respectively. Each of the suction passages 53*d* of the respective reserve ink tanks 20Y, 20M, 20C, and 20K is selectively opened as the stopper 300 rotates about its central axis "0". In the status represented in FIG. 20, the suction passages 53*d* of the reserve ink tanks 20M, 20C, and 20K are closed, because stopper groups 302, 303 and 304 faces and presses those passages 53*d*, while the suction passage 53*d* of the reserve tank 20Y is opened because stopper group 301 detaches from the passage 53*d*. In the status in FIG. 21, only the suction passage 53*d* of the reserve ink tank 20C is opened.

During the action of supplying ink to the reserve ink tanks 20Y, 20M, 20C, and 20K, one of the suction passages 53*d* is opened at first. Then, negative pressure is caused in each ink tank 20 from the suction port 53*b* as in the case of the embodiment described above. The negative pressure allows the supply of ink through the ink inlet 20*b*. Hereinafter, the process including these steps is so-called "the action of supplying ink". The action of supplying ink allows the supply of ink to the reserve ink tanks 20Y, 20M, 20C, and 20K in a selective manner. The stopper 300 may close all of the suction passages 53*d* except when the action of supplying ink is currently in progress.

Figure 22:
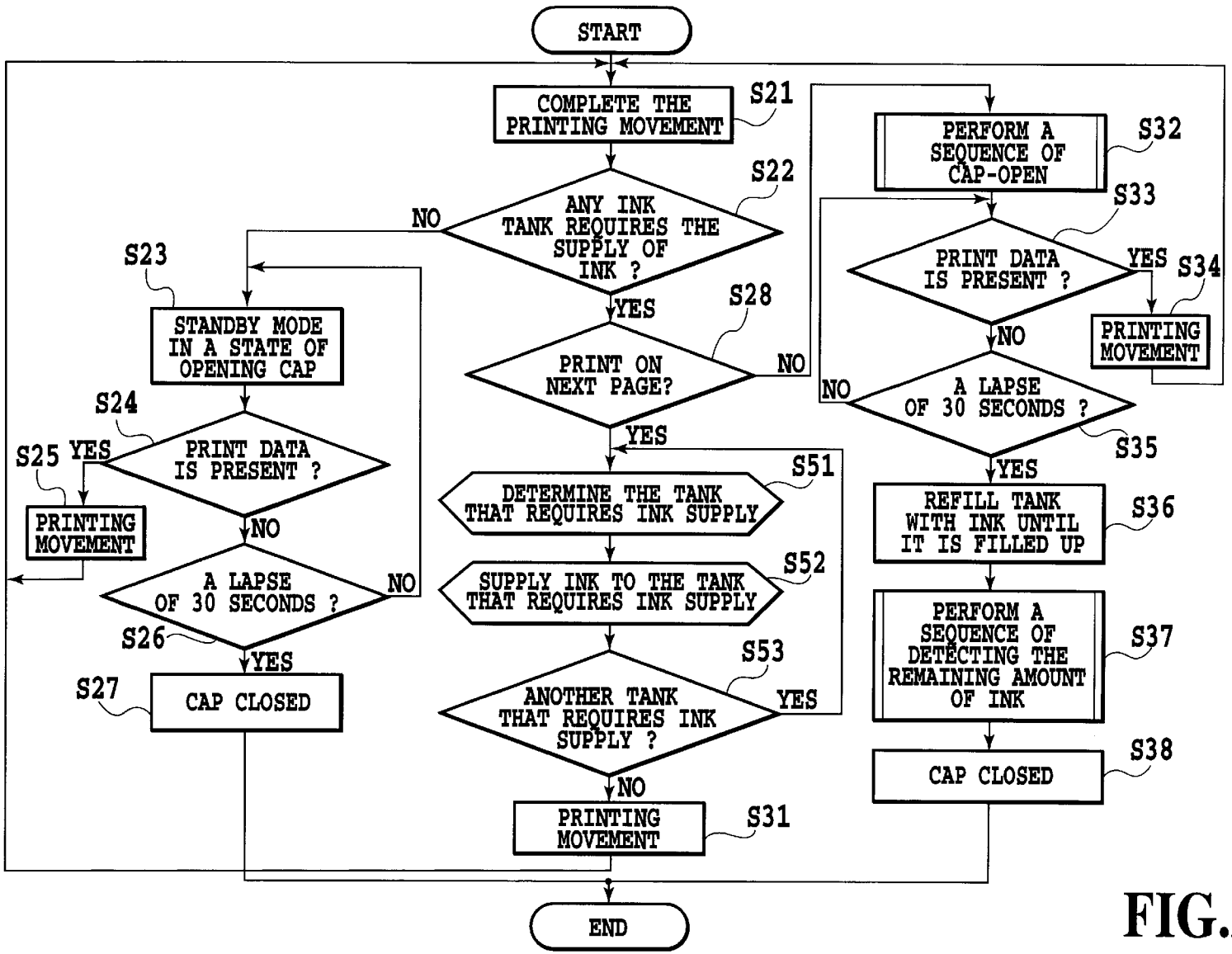
FIG. 22 is a flow chart for illustrating the action of ink supply to the ink tank of FIG. 18.

FIG. 22 is a timing chart for illustrating a series of the action of supplying ink. The same steps as those of the second embodiment are not described in the following description and the same structural components have the same reference numerals just as in the case of the second embodiment.

In the present embodiment, steps S51, S52, and S53 are performed instead of steps S29 and S30 in the second embodiment. That is, if there is a need for supplying ink and printing the next page of the printing medium, the process proceeds from the step S28 to the step S51. In the step S51, it is judged which reserve ink tank 20 requires the supply of ink. If the criterion of the judgement is the level "L" of ink and the level of ink in each of the reserve ink tanks 20Y, 20M, 20C, and 20K is in the state shown in FIG. 18, it is determined that the reserve ink tanks 20Y, 20C require the supply of ink. Subsequently, the suction passage 53*d* of orie of the reserve ink tanks that require the supply of ink is opened for refilling it, so that it receives ink by the action of ink supply (step S52). The reserve ink tank 20 is refilled with the ink by such a step of supplying ink so that the remaining amount of ink in the ink tank reaches a predetermined level (i.e., a target remaining amount of the ink). The target remaining amount of ink may be defined as the amount of ink that corresponds to the predetermined level "L" of ink. Moreover, the target remaining amount of ink may be also defined as the minimum amount of ink to be required for printing an image on the next one page.

Subsequently, the process returns to the step S51 if the reserve ink tank that requires the supply of ink remains about the same. Then, the suction passage 53*d* of such an ink tank is opened by the stopper 300, followed by the supply of ink in an analogous fashion (step S52). If there is no reserve ink tank that requires the supply of ink, the printing movement for the next one page is performed (step S31).

Figure 20:
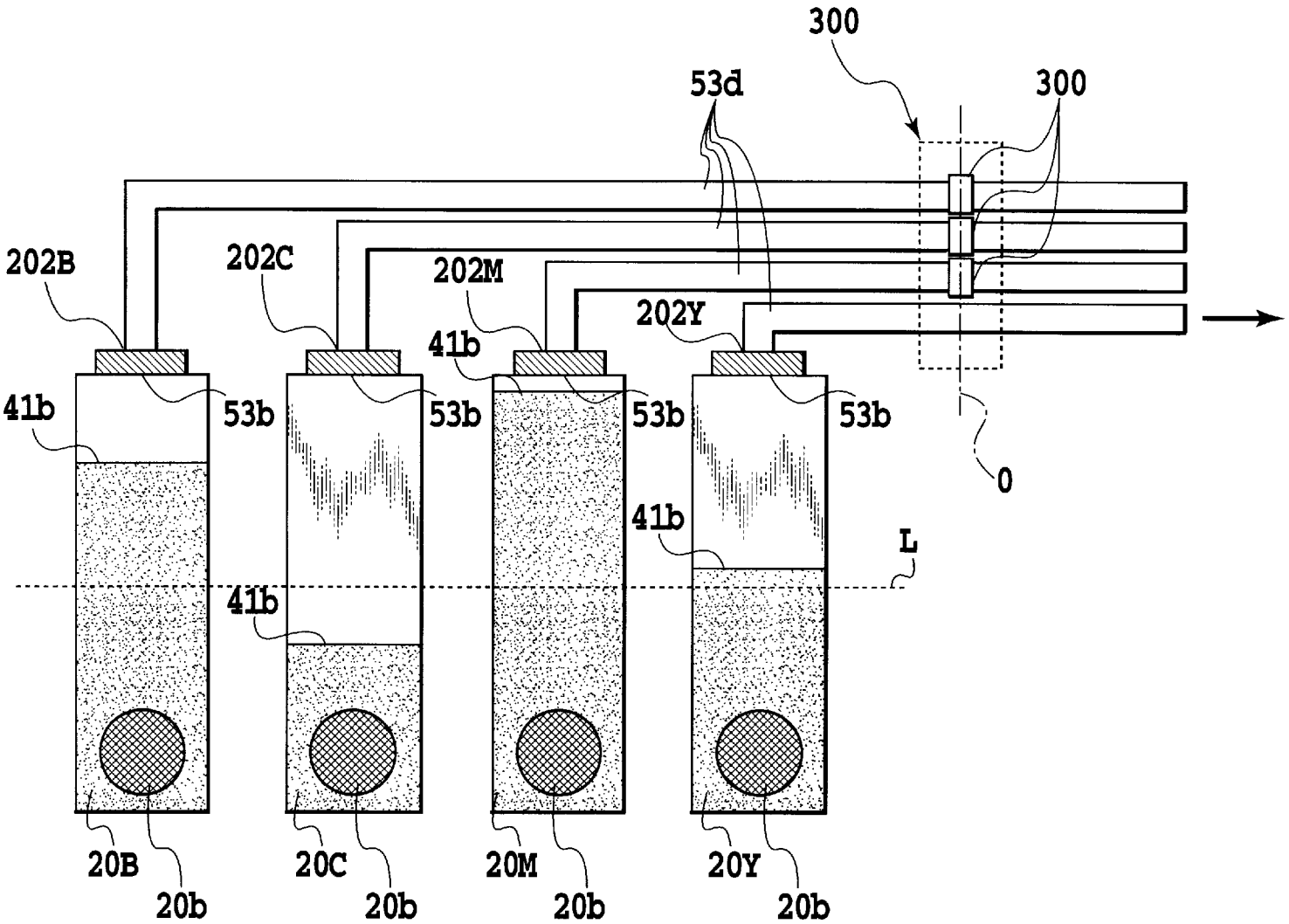
FIG. 20 is an explanatory view that illustrates the status of the air suction system at the time of supplying ink to one of the ink tanks of FIG. 18.
Figure 21:
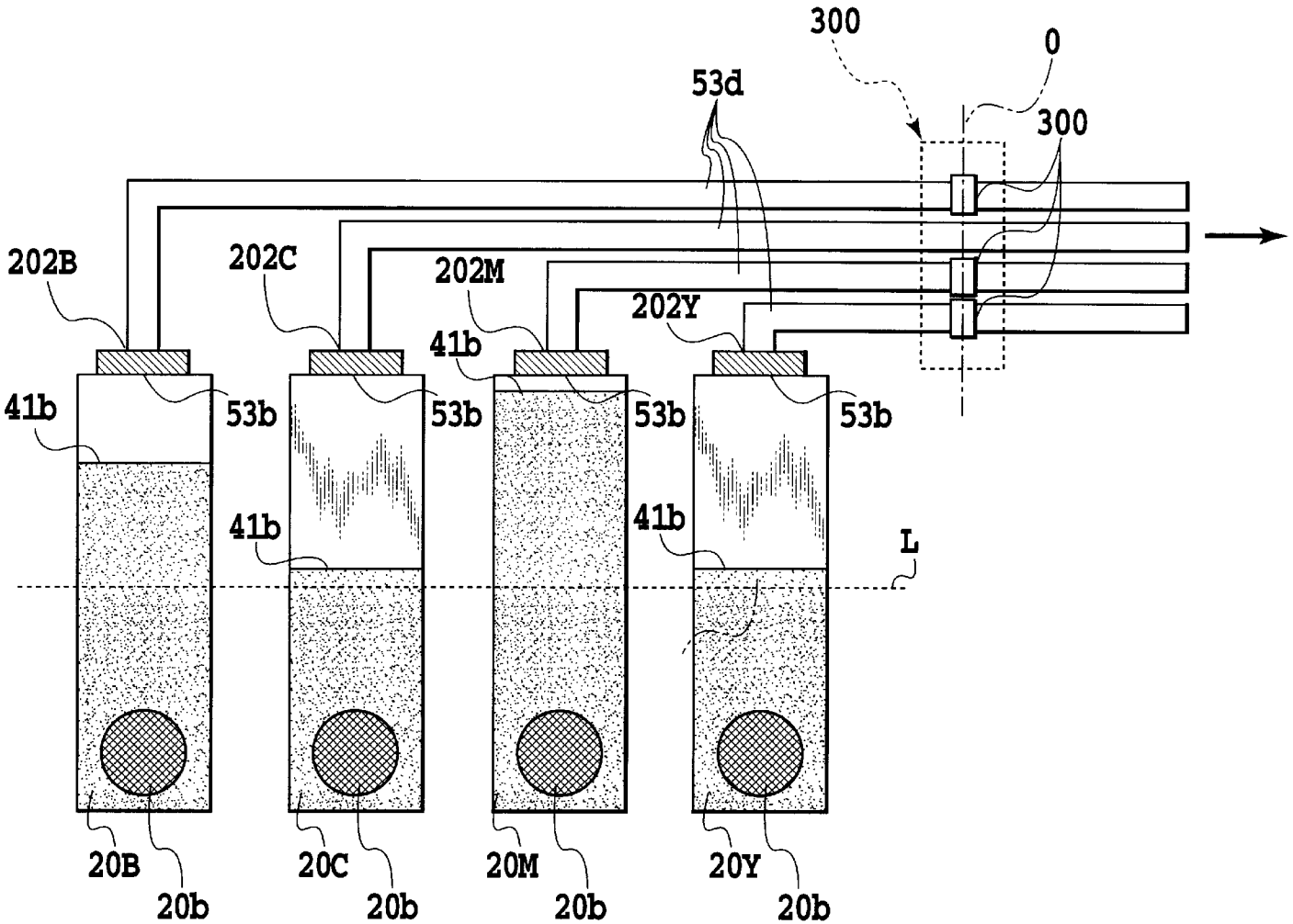
FIG. 21 is an explanatory view that illustrates the status of the air suction system at the time of supplying ink to anther ink tank of FIG. 18.

As shown in FIG. 18, for example, it is judged that the reserve ink tanks 20Y, 20C require the supply of ink. In addition, the remaining amount of ink in the reserve ink tank 20Y is less than that of the reserve ink tank 20Y, so that the supply of ink is performed on the reserve ink tank 20Y at first as shown in FIG. 20, followed by the supply of ink to the reserve ink tank 20C as shown in FIG. 21.

In the present embodiment, by the way, at least two suction passages 53*d* may be concurrently opened for supplying ink to a plurality of the reserve ink tanks at a time. In this case, the supply of ink can be automatically stopped by installing a gas-permeable member (not shown) on each suction port 53*b* just as in the case of the above embodiments.

[Fourth Preferred Embodiment]

In this embodiment, an ink detector is installed in the suction port 53*b* of the reserve ink tank (sub ink tank) 20 having the gas-permeable member 48, so that the status of ink-supply can be confirmed all the time. As a result it is a possible that cope with the status of ink-supply. If ink is not arrived at the gas-permeable member 48 within a fixed time period, it is determined that there is no ink in the supplementary ink tank (i.e., the main ink tank) to refill ink to the reserve ink tank 20 and such a status is represented by a display means. Alternatively, the status of ink supply may be displayed after verifying that ink is filled up to the level of the gas-permeable member 48.

FIGS. 23 to 27 are explanatory views that illustrate the configuration of the ink detector.

Figure 23:
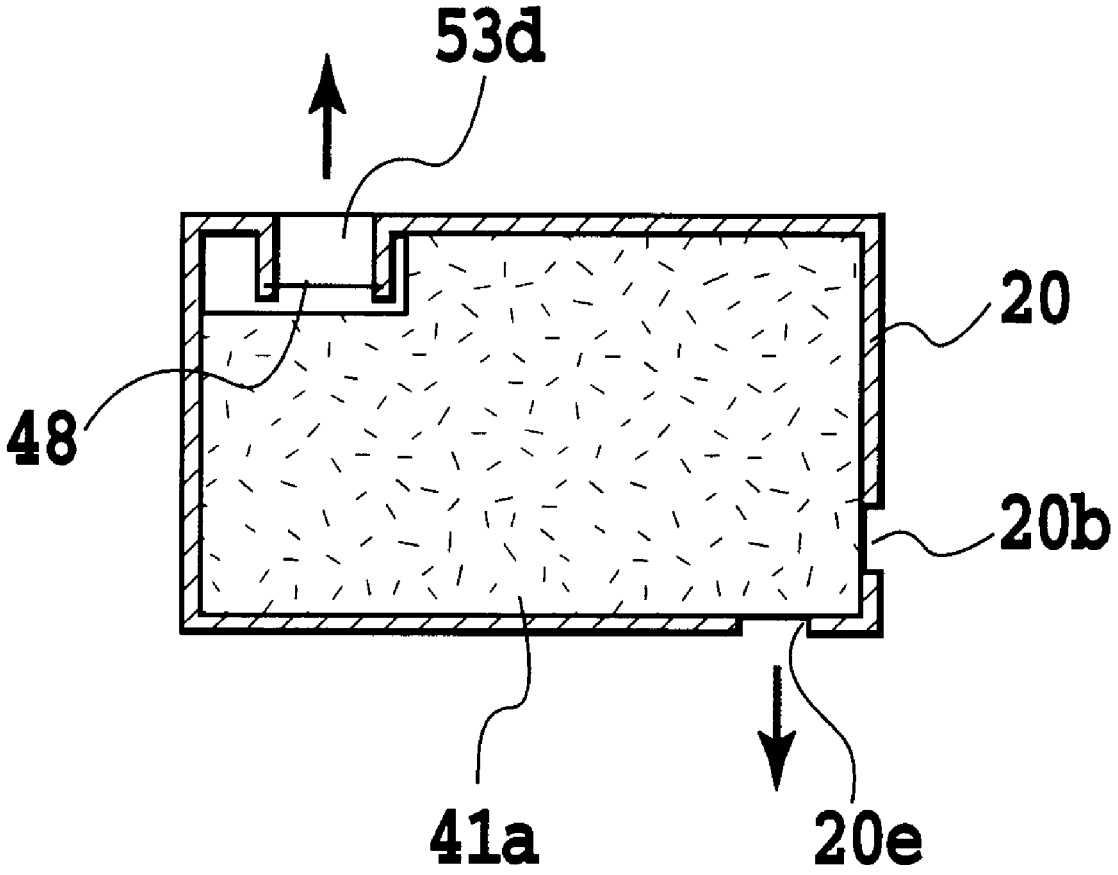
FIG. 23 is an explanation view of the configuration of the ink tank on which the ink-detecting device can be mounted in accordance with the present invention.

FIG. 23 is a schematic structural view of a reserve ink tank 20 having a gas-permeable member 48 in a suction port 53*b*. The reference numeral 20*b* denotes a supply port (an ink inlet) to be connected to a supplementary ink tank (a main ink tank) for supplying ink to the reserve ink tank 20. The reference numeral 20*e* denotes a supply port for supplying ink to an ink-jet printing head. Furthermore, the reference numeral 41*a* denotes an ink absorber for retaining ink by absorption.

Figure 24:
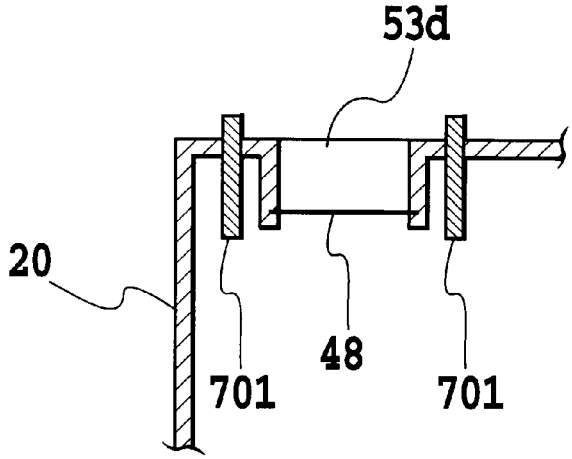
FIG. 24 is a cross sectional view of a major part of the ink tank of FIG. 23 on which the ink-detecting device can be mounted.
Figure 25A:
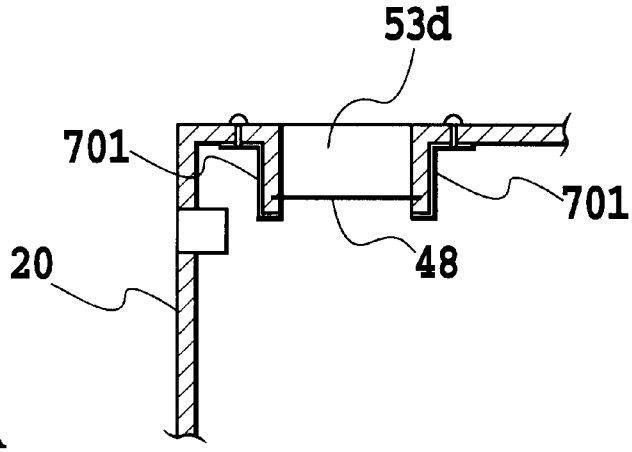
FIG. 25A is a cross sectional view that illustrates another configuration of the ink-detecting device can be mounted on the ink tank of FIG. 23
Figure 25B:
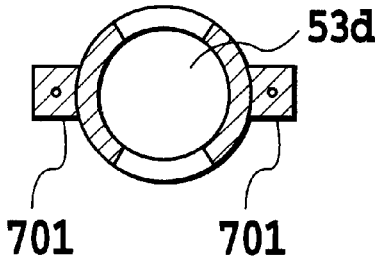
FIG. 25B is a bottom view of the ink-detecting device.
Figure 26:
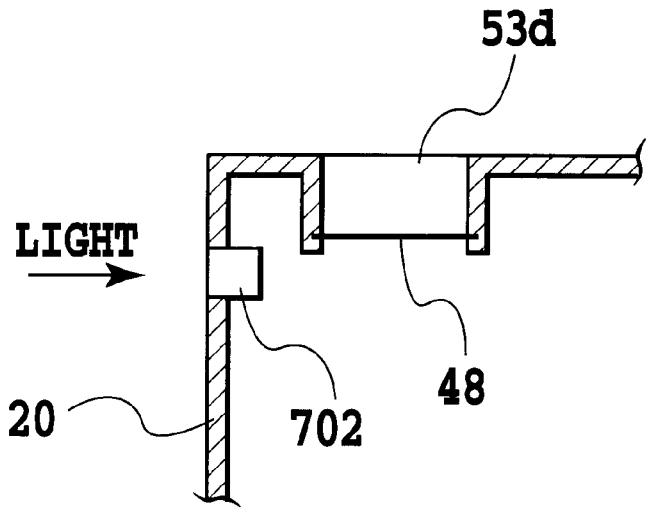
FIG. 26 is a cross sectional view that illustrates further another configuration of the ink tank on which the ink-detecting device can be mounted on the ink tank of FIG. 23.
Figure 27:
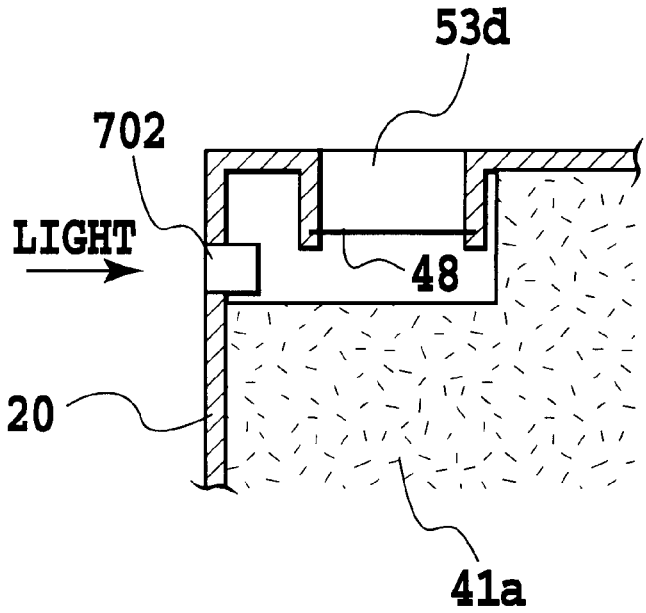
FIG. 27 is a cross sectional view that illustrates further another configuration of the ink-detecting device can be mounted on the ink tank of FIG. 23.

In a case of FIG. 24, an ink detector comprises a pair of electrodes 701 being placed near the gas-permeable member 48. The ink detector detects the presence or absence of ink between the electrodes 701. In a case of FIGS. 25A and 25B, on the other hand, an ink detector comprises a pair of electrodes 701 being curved around the peripheral wall of the suction port 53*b*. In a case of FIG. 26, furthermore, there is an optical detecting means that comprises an prism 702 in the space near the gas-permeable member 48 so that the presence and absence of ink in such a space is detected. In a case of FIG. 27, alternatively, a prism 702 is located in the space between the ink absorber 41*a* and the gas-permeable member 48.

The ink tank having one of the above ink detecting means may be configured so that it is detachably connected to an ink-supplying system and an air suction system as required or it is normally connected to these systems. In addition, the ink absorber 41*a* is not an absolute necessity for the present embodiment.

[Fifth Preferred Embodiment]

In this embodiment, the characteristics and shapes of a gas-permeable member 48 of each reserve ink tanks 20 (20Y, 20M, 20C, and 20B) may be modified with reference to the characteristics of ink, the amount of ink to be stored in such an ink tank, or the like.

The gas-permeable member 48 may be a porous body having its own characteristics and shape based on a desired level of negative pressure to be caused in the reserve ink tank 20 in accordance with the type of ink to be stored and the ink capacity of the reserve ink tank 20 in which the gas-permeable member 48 is installed. Concretely, the gas-permeable member 48 may be a porous body having its own pore diameter and thickness. Alternatively, an occupying area of the gas-permeable member 48 in a ventilating path 49 in may be formed so as to have its own dimension, while the gas-permeable member 48 maybe adopted in size or shaped in accordance with the occupying area of the gas-permeable member 48 in the ventilating path 49. The occupying area of the gas-permeable member 48 may be a variable one having a lid member that covers the surface of the gas-permeable member 48 in an adjustable or variable manner.

The supply rate of ink to each of the reserve ink tanks 20 (20Y, 20M, 20C, and 20C) can be controlled by adjusting a level of negative pressure in the reserve ink tank 20. If the reserve ink tank 20 stores the ink having a large flow resistance or the ink capacity of the ink tank 20 is comparatively large, an appropriate gas-permeable member 48 is selected to adjust negative pressure in the reserve ink tank 20 to a comparatively large level for efficiently supplying ink to one or more reserve ink tanks 20.

As described above, therefore, the characteristics of the gas-permeable member 48 can be optically adjusted using parameters such as a pore size and a thickness of the gas-permeable member 48 or an opening area of the ventilating path 49. In addition, the materiality (e.g., the gas permeability) of the gas-permeable member 48 itself can be made different.

[Other Embodiments]

The gas-permeable member may be of having the function of separating gas and liquid, so that various kinds of materials may be used in accordance with the types of ink or usage patterns. The gas-permeable member may be a gas-permeable film made of a tetrafluoride ethylene resin or other porous resin materials. However, it is also possible to use another porous material made of a natural or synthesis material such as knitted fabric, woven fabric, non-woven fabric, net, felt, porcelain, unglazed pottery, earthenware, or ceramic. Furthermore, the gas-permeable member may be a mechanical valve that is closed when gas comes and opened when the flow of liquid comes.

The ink tank of the present invention is not limited to the one that moves together with the printing head in the serial-scan type printing apparatus. It is also possible to fix the ink tank in place while the printing head moves.

In addition, the present invention may be also configured that the main tank for supplying to the ink tank is always connected to the ink tank through the tube. In this case, furthermore, the ink tank is not limited to the one that moves together with the printing head. It is also possible to fix the ink tank in place.

The present invention may adopt any of various modes of image formation, for example a mode of printing an image on one line basis or one page basis. It is essential only that the change in the way of ink supply eventually increases the printing rate.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink-jet printing apparatus for printing an image on a printing medium using an ink jet printing head that is capable of ejecting ink supplied from an ink tank, comprising:

ink-supplying means that is capable of supplying ink to the ink tank, the ink-supplying means comprising:

a negative-pressure introducing portion that introduces negative pressure into the ink tank; and an ink-introducing portion that introduces ink into the ink tank by the negative pressure in the ink tank, wherein the negative-pressure introducing portion and the ink-introducing portion are detachably connected to the ink tank by a joint member respectively;

detecting means for detecting the time of ink-supply as the ink tank requires the supply of ink; and control means that makes a change to a mode of supplying ink to the ink tank by the ink-supplying means in accordance with the status of actuating the ink-jet printing apparatus at the time of ink-supply which is determined by the detecting means.

2. An ink-jet printing apparatus as claimed in claim 1, further comprising:

gas-liquid separating means provided in a suction passage between the negative-pressure introducing portion and the ink tank, wherein the gas-liquid separating means permits gas to pass but inhibits ink from passing.

3. An ink-jet printing apparatus as claimed in claim 1, wherein the control means alters the contents of controlling the ink-supplying means in accordance with the condition whether the time of ink-supply determined by the detecting means is in the period of a printing movement of the ink-jet printing apparatus.

4. An ink-jet printing apparatus as claimed in claim 3, wherein a printing movement of the ink-jet printing apparatus includes one or more printing movement stages, where an image corresponding to a predetermined area of a printing medium is formed by each stage during the printing movement of the ink-jet printing apparatus.

5. An ink-jet printing apparatus as claimed in claim 3, wherein a printing movement of the ink-jet printing apparatus includes one or more printing movement stages, where an image corresponding to one page of a printing medium is formed by each stage during the printing movement of the ink-jet printing apparatus.

6. An ink-jet printing apparatus as claimed in claim 3, further comprising:

a determining means for determining that the time of feeding or ejecting the printing medium is not in the period of the printing movement of the ink-jet printing apparatus, with respect to the position of a printing movement of the printing head.

7. An ink-jet printing apparatus as claimed in claim 3, further comprising:

a determining means for determining that the time of switching on or off of the ink-jet printing apparatus is not in the period of the printing movement of the ink-jet printing apparatus, with respect to the position of a printing movement of the printing head.

8. An ink-jet printing apparatus as claimed in claim 3, wherein the control means allows the supply of ink not enough to fill up the ink tank by the ink-supplying means when the time of ink supply detected by the detecting means is in the period of the printing movement of the ink-jet printing apparatus.

9. An ink-jet printing apparatus as claimed in claim 3, wherein a printing movement of the ink-jet printing apparatus includes one or more printing movement stages, where an image corresponding to a predetermined area of a printing medium is formed by each stage during the printing movement of the ink-jet printing apparatus, and when the time of ink supply detected by the detecting means is in the period of the printing movement of the ink-jet printing apparatus, the control means allows the ink-supplying means to supply ink to the ink tank in the amount of ink to be required for the formation of an image corresponding to the next predetermined area of the printing medium.

10. An ink-jet printing apparatus as claimed in claim 3, wherein a printing movement of the ink-jet printing apparatus includes one or more printing movement stages, where an image corresponding to one page of a printing medium is formed by each stage during the printing movement of the ink-jet printing apparatus, and when the time of ink supply detected by the detecting means is in the period of the printing movement of the ink-jet printing apparatus, the control means allows that the ink-supplying means supplies ink to the ink tank so that the amount of ink in the ink tank is higher than the amount of ink to be required to the formation of an image corresponding to the next page of the printing medium.

11. An ink-jet printing apparatus as claimed in claim 3, wherein a printing movement of the ink-jet printing apparatus includes one or more printing movement stages, where an image corresponding to a predetermined area of a printing medium is formed by each stage during the printing movement of the ink-jet printing apparatus, and the detecting means detects the time of ink supply when the amount of ink in the ink tank is not enough to print an image corresponding to the next predetermined area of the printing medium.

12. An ink-jet printing apparatus as claimed in claim 3, wherein a printing movement of the ink-jet printing apparatus includes one or more printing movement stages, where an image corresponding to a page of a printing medium is formed by each stage during the printing movement of the ink-jet printing apparatus, and the detecting means detects the time of ink supply when the amount of ink in the ink tank is not enough to print an image corresponding to the next page of the printing medium.

13. An ink-jet printing apparatus as claimed in claim 1, wherein the ink-jet printing apparatus prints an image in accordance with received printing data, the control means allows the supply of ink from the ink-supplying means to the ink tank when the printing data is not received within a predetermined time period.

14. An ink-jet printing apparatus as claimed in claim 1, wherein the ink-jet printing head is provided with an electrothermal converting element that generates thermal energies to be used as energies for ejecting ink.

15. An ink-jet printing apparatus for printing an image on a printing medium using an ink jet printing head that is capable of ejecting ink supplied from an ink tank, comprising:

ink-supplying means that is capable of supplying ink to the ink tank; detecting means for detecting the time of ink-supply as the ink tank requires the supply of ink; and control means that makes a change to a mode of supplying ink to the ink tank by the ink-supplying means in accordance with the status of actuating the ink-jet printing apparatus at the time of ink-supply which is determined by the detecting means, wherein the ink-jet printing apparatus prints an image in accordance with received printing data, the control means allows the supply of ink from the ink-supplying means to the ink tank when the printing data is not received within a predetermined time period after capping the ink-jet printing head by a cap member.

16. An ink-jet printing apparatus for printing an image on a printing medium using an ink jet printing head that is capable of ejecting ink supplied from a plurality of ink tanks, comprising:

ink-supplying means that is capable of supplying ink to each of the plurality of ink tanks;

detecting means for detecting the time of ink-supply as the each of the plurality of ink tanks require the supply of ink; and control means that makes a change to a mode of supplying ink to one of the plurality of ink tanks by the ink-supplying means in accordance with the status of actuating the ink-jet printing apparatus at the time of ink-supply which is determined by the detecting means, wherein the ink-supplying means selectively supplies ink to the plurality of the ink tanks, the detecting means detects the time of ink supply that each of the plurality of the ink tanks requires the supply of ink, and the control means changes to a mode of supplying ink by the ink-supplying means in accordance with both the status of actuating the ink-jet printing apparatus at the time of ink supply detected by the detecting means and the information of the ink tank detected as a target of ink supply by the detecting means, wherein the control means allows the supply of ink to the only ink tank detected as a target of ink supply by the detection means when the time of ink supply detected by the detecting means is in the period of the printing movement of the ink-jet printing apparatus.

17. An ink-jet printing apparatus as claimed in claim 16, wherein the control means allows the supply of ink to each of the plurality of the ink tanks when the time of ink supply detected by the detecting means is not in the period of the printing movement of the ink-jet printing apparatus.

18. An ink-jet printing apparatus as claimed in claim 16, wherein each of the plurality of the ink tanks keeps its own ink different from others.

19. An ink-jet printing apparatus for printing an image on a printing medium using an ink jet printing head that is capable of ejecting ink supplied from a plurality of ink tanks, comprising:

ink-supplying means that is capable of supplying ink to each of the plurality of ink tanks;

detecting means for detecting the time of ink-supply as the each of the plurality of ink tanks require the supply of ink; and control means that makes a change to a mode of supplying ink to one of the plurality of ink tanks by the ink-supplying means in accordance with the status of actuating the ink-jet printing apparatus at the time of ink-supply which is determined by the detecting means, wherein the ink-supplying means comprises a negative-pressure introducing portion that introduces negative pressure into each of the plurality of the ink tanks through gas-liquid separating means at the same time, and an ink-introducing portion that introduces ink into the plurality of the ink tanks by the negative pressure in the ink tanks;

the detecting means detects the time of ink supply that each of the plurality of the ink tanks requires the supply of ink; and the control means changes a mode of supplying ink by the ink-supplying means in accordance with the status of actuating the ink-jet printing apparatus at the time of ink supply detected by the detecting means and the information of the ink tank detected as a target of ink supply by the detecting means.

20. An ink-jet printing apparatus as claimed in claim 19, wherein the control means allows the supply of ink not enough to fill up the ink tank detected as a target of ink supply by the detecting means when the time of ink supply detected by the detecting means is in the period of the printing movement of the ink-jet printing apparatus.

21. A ink-jet printing apparatus according to any of claims 1, 2, 3 to 16 and 17 to 18, wherein the plurality of ink-jet printing heads have an electrothermal converting element that generates thermal energy as ink ejection energy respectively.

22. An ink-supplying apparatus to be actuated in relation to the operation of an ink-jet printing apparatus that performs an image formation on a printing medium using an ink-jet printing head that is capable of ejecting ink to be supplied from an ink tank, comprising:

ink-supplying means that is capable of supplying ink to the ink tank, the ink-supplying means comprising:

a negative-pressure introducing portion that introduces negative pressure into the ink tank; and an ink-introducing portion that introduces ink into the ink tank by the negative pressure in the ink tank, wherein the negative-pressure introducing portion and the ink-introducing portion are detachably connected to the ink tank by a joint member respectively;

detecting means for detecting the time of ink-supply as the ink tank requires the supply of ink; and control means that makes a change to a mode of supplying ink to the ink tank by the ink-supplying means in accordance with the status of actuating the ink-jet printing apparatus at the time of ink-supply which is determined by the detecting means.

23. An ink-supplying apparatus as claimed in claim 22, further comprising;

gas-liquid separating member provided in a suction passage between the negative-pressure introducing portion and the ink tank, wherein the gas-liquid separating means permits gas to pass but inhibits ink from passing.

24. An ink-supplying apparatus as claimed in claim 22, wherein the control means alters the contents of controlling the ink-supplying means in accordance with the condition whether the time of ink-supply determined by the detecting means is in the period of a printing movement of the ink-jet printing apparatus.

25. An ink-jet printing apparatus for printing an image on a printing medium using an ink jet printing head that is capable of ejecting ink supplied from an ink tank, comprising:

ink-supplying means that is capable of supplying ink to the ink tank, the ink-supplying means comprising:

a negative-pressure introducing portion that introduces negative pressure into the ink tank; and an ink-introducing portion that introduces ink into the ink tank by the negative pressure in the ink tank;

detecting means for detecting the time of ink-supply as the ink tank requires the supply of ink;

control means that makes a change to a mode of supplying ink to the ink tank by the ink-supplying means in accordance with the status of actuating the ink-jet printing apparatus at the time of ink-supply which is determined by the detecting means; and gas-liquid separating means provided in a suction passage between the negative-pressure introducing portion and the ink tank, wherein the gas-liquid separating means permits gas to pass but inhibits ink from passing, wherein an ink-detecting means detects ink arrived at a position near the gas-liquid separating means.

26. An ink-jet printing apparatus as claimed in claim 25, wherein the gas-liquid separating means is provided on a suction port of the ink tank that communicates with the negative-pressure introducing portion.

27. An ink-jet printing apparatus as claimed in claim 25, comprising:

a means for judging that there is no ink in a main ink tank provided for supplying ink to the ink tank when the ink detecting means detects no ink during the action of ink supply by the ink-supplying means over a predetermined time period.

28. An ink-jet printing apparatus as claimed in claim 25, wherein the ink-detecting means electrically detects ink between electrodes.

29. An ink-jet printing apparatus as claimed in claim 25, where in the ink-detecting means optically detects ink using an optical prism.

30. An ink-jet printing apparatus as claimed in claim 25, wherein the ink-detecting means is placed in a space between an ink absorber stored in the ink tank and the gas-liquid separating means.

31. A ink-jet printing apparatus for printing an image on a printing medium using a plurality of ink-jet printing heads capable of ejecting ink supplied from respective ones of a plurality of ink tanks, the apparatus comprising:

ink-supplying means that is capable of supplying ink to each of the ink tanks, the ink-supplying means comprising a negative-pressure introducing portion that introduces negative pressure into the ink tank and an ink-introducing portion that introduces ink into the ink-tank by the negative pressure in the ink tank respectively;

detecting means for detecting the time of ink supply as the ink tank requires the supply of ink; and control means that makes a change to a mode of supplying ink to the ink tanks by the ink-supplying means in accordance with the status of actuating the ink-jet printing apparatus at the time of ink-supply which is determined by the detecting means, wherein, the control means supplies ink to only the ink tank detected as an ink supply target by the detecting means so that an ink quantity in the ink tank is equal to or larger than an ink quantity required for image printing for a next one page of the printing medium, if print data for the next page has been received, and supplies ink so that ink is filled in all the ink tanks by the supplying means if print data for the next page is not received and if no print data is received for a predetermined time or more.

32. An ink-jet printing apparatus as claimed in claim 31, further comprising a suction passage between the negative-pressure introducing portion and the ink tank, wherein a gas-liquid separating means that permits gas to pass, but inhibits ink from passing is provided in the suction passage.

33. An ink-jet printing apparatus as claimed in claim 32, further comprising:

an ink-detecting means for detecting ink arrived at a position near the gas-liquid separating means; and judging means for judging that no ink is present in a main ink tank that is an ink supply source for the ink tank, when the ink-detecting means does not detect ink during a given time length or a longer period of an ink supplying movement of the ink-supplying means.

34. An ink-jet printing apparatus as claimed in claim 31, wherein the negative-pressure introducing portion and the ink-introducing portion are detachably connected to the ink tank by a joint member respectively.

35. An ink-jet printing apparatus as claimed in claim 31, wherein ink filling when print data for a next page is received is to supply ink when the printing medium is supplied and/or ejected.

36. An ink-jet printing apparatus as claimed in claim 31, wherein the detecting means detects an ink supply time when an ink quantity in at least one of the ink tanks is smaller than an ink quantity required for image printing for the next one page of the printing medium.

37. An ink-jet printing apparatus as claimed in claim 31, wherein the plurality of ink tanks contain different inks.

38. An ink supplying method for an ink-jet printing apparatus which comprises a plurality of ink-jet printing heads capable of ejecting ink supplied from respective ones of a plurality of ink tanks, and ink-supplying means capable of supplying ink to each of the ink tanks that reserve ink to be supplied to the ink-jet printing heads respectively, comprising the steps of:

detecting a time of ink supply as the ink tank requires the supply of ink, wherein when the time of ink-supply is detected, if print data for a next page has been received, supplying ink to only the ink tank detected as an ink supply target by the detecting step so that an ink quantity in the ink tank is equal to or larger than an ink quantity required for image printing for the next one page of a printing medium, and if print data for the next page is not received and if no print data is received for a predetermined time or more, supplying ink so that ink is filled in all the ink tanks by the ink-supplying means.

* * * * *

UNITED STATES PATENT AND TRADEMARK OFFICE

CERTIFICATE OF CORRECTION

PATENT NO. : 6,447,084 B1
DATED : September 10, 2002
INVENTOR(S) : Uetsuki et al.

It is certified that error appears in the above-identified patent and that said Letters Patent is hereby corrected as shown below:

Column 2,
Line 20, “eject” should read -- ejecting --.

Column 3,
Lines 7, 14, 16, 20, 23 and 26, “cross sectional” should read -- cross-sectional --; and
Line 10, “sin” should read -- in --; and “cross sectional” should read -- cross-sectional --.

Column 4,
Lines 6, 9, 13 and 17, “cross sectional” should read -- cross-sectional --.

Column 5,
Line 49, “independent” should read -- independent of --.

Column 6,
Line 17, “on” should be deleted; and
Line 44, “bug” should read -- bung --.

Column 12,
Line 59, “currently” should read -- currently in --.

Column 13,
Line 5, “a-capping” should read -- a capping --.

Column 14,
Line 31, “one” should read -- once --.

Column 15,
Line 8, “detect” should read -- detects --; and
Line 64, “orie” should read -- one --.

Column 16,
Line 33, “a” (second occurrence) should be deleted; and
Line 34, “that” should read -- to --.

Column 17,
Line 19, “in” should be deleted;
Line 20, “maybe” should read -- may be --; and
Line 50, “synthesis” should read -- synthetic --.

UNITED STATES PATENT AND TRADEMARK OFFICE

CERTIFICATE OF CORRECTION

PATENT NO. : 6,447,084 B1
DATED : September 10, 2002
INVENTOR(S) : Uetsuki et al.

It is certified that error appears in the above-identified patent and that said Letters Patent is hereby corrected as shown below:

Column 20,
Line 18, "tank; detecting" should begin a new paragraph before -- detecting --.

Column 21,
Line 44, "1, 2, 3 to 16 and 17 to 18," should read -- 1 to 13 and 15 to 20, --.

Column 22,
Line 4, "comprising;" should read -- comprising: --; and
Line 57, "where in" should read -- wherein --.

Signed and Sealed this

Twenty-third Day of September, 2003

JAMES E. ROGAN
*Director of the United States Patent and Trademark Office*